US007938594B1

(12) United States Patent
Schindler

(10) Patent No.: US 7,938,594 B1
(45) Date of Patent: May 10, 2011

(54) HOLDING DEVICE FOR TRAFFIC BEACON

(75) Inventor: Robert J. Schindler, Anna Maria, FL (US)

(73) Assignee: Qwick Kurb, Inc., Ruskin, FL (US)

( * ) Notice: Subject to any disclaimer, the term of this patent is extended or adjusted under 35 U.S.C. 154(b) by 322 days.

(21) Appl. No.: 11/821,650

(22) Filed: Jun. 25, 2007

Related U.S. Application Data

(63) Continuation-in-part of application No. 11/070,563, filed on Mar. 2, 2005, now Pat. No. 7,325,999.

(51) Int. Cl.
*E01F 9/011* (2006.01)

(52) U.S. Cl. ..... 404/9; 404/6; 404/10

(58) Field of Classification Search ..... 404/6–10; 256/13.1
See application file for complete search history.

(56) References Cited

U.S. PATENT DOCUMENTS

| | | | | |
|---|---|---|---|---|
| 563,699 | A | 7/1896 | White | |
| 804,390 | A | 11/1905 | Duffy | |
| 997,053 | A | 7/1911 | Fritz | |
| 1,698,150 | A | 1/1929 | Baird | |
| 1,755,443 | A | 4/1930 | Hartzler et al. | |
| 1,766,073 | A * | 6/1930 | Hartzler et al. | 404/10 |
| 2,121,961 | A | 6/1938 | Gill | |
| 1,773,488 | A | 8/1940 | Hines | |
| 2,214,685 | A | 9/1940 | Stone, Jr. | |
| 2,893,668 | A | 7/1959 | Applegate | |
| 3,091,997 | A | 6/1963 | Byrd | |
| 3,245,181 | A | 4/1966 | Stephenson | |
| 3,451,319 | A | 6/1969 | Gubela | |
| 3,799,686 | A | 3/1974 | Williams | |
| 4,154,037 | A | 5/1979 | Anderson | |
| 4,269,534 | A | 5/1981 | Ryan | |
| 4,461,387 | A | 7/1984 | Belokin, Jr. | |
| 4,596,489 | A | 6/1986 | Mariol et al. | |
| 4,645,168 | A | 2/1987 | Beard | |
| 5,104,255 | A * | 4/1992 | Bodensohn | 404/7 |
| 5,527,127 | A * | 6/1996 | Junker | 404/6 |
| 5,775,834 | A * | 7/1998 | Jackson | 404/15 |
| 6,109,820 | A * | 8/2000 | Hughes, Sr. | 404/10 |
| 7,077,599 | B1 * | 7/2006 | Hughes, Jr. | 404/10 |

* cited by examiner

*Primary Examiner* — Raymond W Addie
(74) *Attorney, Agent, or Firm* — Frijouf, Rust & Pyle, P.A.

(57) ABSTRACT

An improved holding device is disclosed for supporting a traffic beacon comprising a longitudinal extending holding member having a bottom surface for resting on a generally flat surface. The longitudinal extending holding member has opposed inclined sidewalls meeting in a generally planar top surface. A coupling device is defined within the longitudinal extending holding member for securing a traffic beacon to the holding member. A riser is integrally formed with the generally planar top surface of the longitudinal extending holding member for raising the height of the improved holding device.

11 Claims, 23 Drawing Sheets

PRIOR ART

PRIOR ART

PRIOR ART

HOLDING DEVICE FOR TRAFFIC BEACON

CROSS REFERENCE TO RELATED APPLICATIONS

This is a continuation-in-part of U.S. patent application Ser. No. 11/070,563 filed Mar. 2, 2005 now U.S. Pat. No. 7,325,999. All subject matter set forth in application Ser. No. 11/070,563 filed Mar. 2, 2005 is hereby incorporated by reference into the present application as if fully set forth herein.

BACKGROUND OF THE INVENTION

1. Field of the Invention

This invention relates to traffic beacons for land vehicles and more particularly to an improved holding device having a novel longitudinal extending holding member for raising the height of the improved holding device.

2. Description of the Related Art

Traffic beacons are used at various locations and are used for various purposes to mark and/or to direct the flow of traffic of motorized vehicles. Traffic beacons are particularly useful where a traffic flow must be partitioned off from an oncoming traffic flow without being separated by broad traffic lane strips. In many cases traffic beacons are used at construction sites to redirect traffic flow about the construction site.

In one form of traffic beacon, a plurality of holding devices are interconnected to form a continuous holding device. The plurality of holding devices are connected in such a manner to enable the continuous holding device to follow a straight or a serpentine path. A multiplicity of vertically extending signaling bodies are coupled to the plurality of holding devices to form a continuous series of traffic beacons. Each of the multiplicity of signaling bodies is coupled to the plurality of holding devices by a coupling device.

The coupling devices comprise a transverse slot defined in each of the plurality of holding devices. In addition, the coupling devices comprise plural outwardly protruding flanges extending from each of the multiplicity of signaling bodies. The transverse slots defined in each of the plurality of holding devices were adapted to receive the plural outwardly protruding flanges extending from the signaling body to couple the signaling bodies to the plurality of holding devices.

The traffic beacons are constructed in such a manner that no damage occurs if a vehicle collides with the traffic beacon. The traffic beacons are constructed to allow the traffic beacon to be bent over and run over when a vehicle collides with the traffic beacon. After the collision, the traffic beacons returns to the upright position due to the elasticity of the traffic beacon.

The following U.S. Patents are believed to be representative of the progress, development and achievements of the traffic beacon of the prior art.

U.S. Pat. No. 1,698,150 to C. M. C. Baird discloses a traffic marker comprising a collapsible resilient tube bearing a sign and means for securing and anchoring the tube in horizontal position to a pavement.

U.S. Pat. No. 1,766,073 to M. E. Hartzler et al. discloses a traffic marker construction normally upstanding display portion of inherently flexible material. A base portion is integral with and of the same material as the display portion and having a substantially horizontal under surface for engaging the surface of the pavement. A core of metal is in the base portion and an anchor for engaging the core and securing the marker to the pavement.

U.S. Pat. No. 2,121,961 to Findlay discloses a traffic marking means for pavements comprising a series of posts arranged in line, the posts consisting of a hollow flexible structure and extending above the -pavement to a height slightly greater than the road clearance of a standard motor vehicle and means for removeably mounting each of the posts in the pavement.

U.S. Pat. No. 2,893,668 to Applegate discloses a holder for a bole comprising a base having a central opening therethrough and having spaced elevating legs adapted to rest upon the floor, a socket member affixed to and extending upwardly from the base and being located over the central opening so as to be open through the base, an upward projection adapted for supporting engagement with the lower end of a bole, the upward projection having its lower end provided with a ball within a socket member for cooperation therewith, rotatable means extending upwardly through the opening in the base and into the socket member for effecting securing engagement of the ball within the socket member so as to constitute a means for varying the angle of the projection with respect to the base, the upward projection being provided co-axially there-about at a point above the socket with an upwardly ex-posed spherical surface portion and a co-axially upturned plate, with an upper concave surface, in centering engagement upon the spherical surface, the plate being of a diameter substantially meter than that of the up-ward projection and being adapted for engagement between the lower end of the bole and the spherical surface upon engagement of the upward projection within the bole.

U.S. Pat. No. 3,091,997 to Byrd discloses a highway marker comprising a base plate adapted to seat on a pavement and means for fastening the base plate to the pavement. The base plate has a downwardly recessed top surface and a peripheral upstanding rim. A resilient vertically extending marker picket has a diametrically enlarged foot portion received in the recessed top surface and within the rim. A top plate has an apertured top surface through which the marker picket slidably extends and a depending peripheral rim embracing the upstanding rim. An upstanding hollow boss is located on the base top surface within the upstanding rim. The foot portion has an aperture receiving the boss. A fastener engages the top plate and the boss and passing through the aperture of the foot portion for securing the former to the-base.

U.S. Pat. No. 4,269,534 to Ryan discloses a replaceable guide post of the type generally used as a road marker and the like, wherein a flexible tubular post member is provided with a mounting-base structure that is arranged to be secured to a ground surface such as a road-way. The base structure comprises a support-base member adapted to receive and engage a lower flanged portion of the tubular post and a retainer collar member, which is positioned over the base member and the lower portion of the guide post, thereby clamping the post therebetween and affixing the base member to the ground surface. An alternative arrangement thereof further includes a removable mounting-ring member provided with a central opening having the peripheral design of the particular tubular post to be employed therewith.

U.S. Pat. No. 4,799,448 to Junker discloses a portable traffic marker. The foot-plate has on its upper side a recess of rectangular or square outline in which the post is inserted. On the post either a portable traffic marker plate is fixed or a portable traffic marker body is fitted. The post has an M profile, the two mutually parallel side segments of which have the same length as each other, which is at least approximately the same as the inside diameter of the recess in the footplate. The two middle segments of the M profile are likewise of the same length and extend from the point of connection with the respective neighboring side segment at least approximately up to the middle of the line joining the free ends of the two side segments of the M profile.

U.S. Pat. No. 5,165,818 to W. A. Newhart discloses a free-standing traffic directing sign consisting of a base, a panel which fits into a slot in the base, and a breakway mounting assembly including a pin. The breakaway mounting assembly is connected to the base and is designed to retain the panel in the slot. When a predetermined force, such as a vehicle striking the sign, is applied to the panel and transmitted to the mounting assembly, the pin of the mounting assembly breaks allowing the panel to pop out of the slot. A new pin can be used to reassemble the panel and the base.

U.S. Pat. No. 5,168,827 to Junker discloses a signaling device having a signaling body and a holding device. The signaling body is designed as a cornet-like hollow body which has four wall regions adjoining one another in the circumferential direction, of which two diametrically opposite wall regions form the wide sides of the signaling body and of which the other two likewise diametrically opposite wall regions form the narrow sides of the signaling body. The wall regions on the narrow side have the form of a conical shell. The wall regions on the wide side are preferably flat. Between the signaling body and the holding device there is a coupling device. The wall regions on the narrow side have above the foot of the signaling body in each case a recess, which has a certain height and which extends in the circumferential direction up to the transitional point with the neighboring wall region on the wide side. The holding device may be designed as a base plate for adhesively fixing, as a foot plate for setting up or as a foot bearing bar for setting up and arranging in line a plurality of signaling devices.

U.S. Pat. No. 5,197,819 to R. K. Hughes discloses an improved apparatus for attaching a flexible marker shaft to a roadway. The flexible lower part of the marker shaft slides over a mandrel, and into a maker shaft cavity. Locking wedges are positioned in the cavity to surround and support the flexible marker support shaft in the cavity. A locking pin passes through a locking pin hole and locks the wedges and the marker shaft into the marker shaft cavity.

U.S. Pat. No. 5,215,399 to J. Berger discloses a barricade or barrier for road-warning signs, which utilizes just one vertical, mounting support-pole to which is mounted the road-hazard or road-warning sign, or the like. The single, vertical support-pole is mounted to a base made of a used tire by means of a pair of bracket-arms, with the two bracket-arms being vertically spaced apart and extending transversely to each other. The two bracket-arms are bolted to the used-tire base, with the upper bracket-arm being bolted to the upper, annular surface of the used tire, and with the lower bracket-arm being bolted to the bottom, annular surface of the tire-base, whereby the two bracket-arms sandwich the tire therebetween for a strong, stable mounting of the support-pole secured to the two bracket-arms. The support-pole is removably mounted to the mounting bracket-arms, and itself is modular in construction to allow for easy assembly and disassembly, and to ensure proper mounting of the two bracket-arms to the tire-base. The tire constituting the base is also provided with a series of drain-holes on its bottom surface and also on its annular rim, so that rain water may be drained out from the tire, regardless of the angular orientation of the barricade and its tire-base.

U.S. Pat. No. 5,484,225 to Warner discloses a two-part traffic channelizing device including a recycled rubber base having a slot with a textured interior surface extending therethrough and a vertically upwardly extending vertical member coated with reflective material and releasably inserted inside the slot forming a friction/compression fit between the vertical member and the textured interior surface of the slot. The vertical member is held in position in the slot by friction/compression alone. Upon impact, the vertical member pops out of the slot and the device is reassembled simply by reinserting the vertical member into the slot; no replacement parts are necessary, except for accessory items such as lighting devices or power sources.

U.S. Pat. No. 5,527,127 to Junker discloses a traffic barrier used in guidance installations having a longitudinal shape and on its upper surface a first part of a coupling device. A second part is provided on a guide body coupling the same to the traffic barrier. On each end the traffic barrier is provided with parts divided from a further coupling device so that the traffic barrier can be coupled to a neighboring traffic barrier in a longitudinal direction. The traffic barrier has a cross-section wherein the outline of the side walls and the upper wall is contiguous with a circumferential curve being at least almost constant in its outline and being substantially convex in its outline but can extend linearly in a side wall area which is adjacent an under side of the barrier until encountering a point of contact of a tangent in the convex area. A step off-set relative to the circumferential curve has been provided in the area of each side wall which off-set in its lower area forms an edge at the circumferential curve and in its upper area is at least almost curved constantly and merges into the circumferential curve.

U.S. Pat. No. 5,566,926 to Voigt discloses a resilient mounting system for safety barriers, including guardrails including a urethane rubber or other resilient material substantially between the periphery of the barrier and a floor or base. The barrier is biased against the base so as to provide an stiff yet resilient impact resistance that yields to absorb the energy of impact, such as from a vehicle, rather than requiring the structural material of the barrier itself to absorb and perhaps become dislodged or deformed by the impact. The resilient material can be shaped generally like the periphery of the barrier or it can be a standard shape that is replicated and arranged to engage a support for the barrier. A rail is resiliently mounted between two supports, the resilient mounting being arranged to permit limited relative movement between the rail and the supports but resisting removal of the rail from the supports.

U.S. Pat. No. 5,630,676 to Junker discloses a marker bump for placement on a traffic lane, particularly for marking a traffic lane when the course of traffic is changed at construction sites or the like. The marker bump comprises links joined in an articulated manner with one another to form a link chain and preferably having a warning color on their upper side. The links are connected with one another over a connecting link, which in each case is hinged on its own pin to the adjacent link. The two links are to be joined to one another in each case having a recess for accommodating the connecting link.

U.S. Pat. No. 5,670,954 to Junker discloses a traffic beacon apparatus having an upper portion comprising a panel member which is attached in an upright position by coupling member to base pedestal. The coupling member is a hollow shell structure formed of an elastic material. The panel member attaches to a top of the coupling member by bolts and barbed projections which are inserted into slots in the top of the coupling member. The coupling member has a flange along a lower perimeter thereof which couples with the base pedestal. The elastic material of the coupling member is more flexible than the panel member that is formed from a relatively stiff material. Apertures are formed in opposing sides of the coupling member to define a bending portion. Sides of the coupling member disposed between the apertures flex and bend upon the traffic beacon being struck by a vehicle. Due to the elastic nature of the coupling member material and the positioning of the apertures, the coupling member permits the panel member to be bent down in a collision and then return to the original upright position.

U.S. Pat. No. 5,678,950 to Junker discloses an invention concerned with producing a visual guiding effect for guide walls that are difficult to see particularly at dusk and in the dark. According to the invention, the guide arrangement comprises a holder which is to be mounted on the guide wall and is provided with a retaining arm, which is elastically resilient at least in the horizontal direction, and a guide member which is mounted on the retaining arm by a coupling device and is provided on at least one side with a guide face which is clearly visible even in conditions of poor visibility.

U.S. Pat. No. 5,788,405 to J. R. Beard discloses a vertical highway marker having a mounting base, a marker post and a mounting bracket. The mounting bracket secures the marker post to the mounting base. The highway marker includes a flexible region which bends so that the marker post will rotate relative to the mounting base when the marker post is impacted by a vehicle. The mounting base is a low-profile, square rubber pad which may be driven over by a vehicle without disturbing the driver's control of the vehicle. A resilient member is disposed proximate to the flexible region of the highway marker for bending with and stiffening the flexible region. Blocking members extend on forward and rearward sides of the resilient member and the flexible region for limiting a range of bending over which the resilient member bends with the flexible region, such that the stresses within the resilient member are not substantially greater than the yield strength of the resilient member. In a preferred embodiment, two strips of the elastomeric belting are used to provide the forward and rearward blocking members. The blocking members are secured on one end to the mounting base and have opposite ends which extend upward on the forward and rearward sides of the marker post.

U.S. Pat. No. 5,933,095 to Junker discloses a traffic beacon, which can be used as a guiding device, particularly for street traffic, having a top member that is provided with warning or informative signs. The top member flips over when a vehicle drives over it. The lower end of the top member is connected via a tilting joint to a footplate or directly to the street surface. Each tilting joint is provided with a spring-loaded locking device, a first stop holding the top member in the vertical position and a second stop serving as a locking device for the top member in a prone position.

U.S. Pat. No. 6,019,543 to Junker discloses a foot for a traffic beacon, serving as routing device for road traffic. At its lower end, the traffic beacon is coupled detachably with the foot. The traffic beacon, at least in its lower part, consists of a soft, elastic material and, at its lower edge, has a laterally protruding flange, which engages appropriately shaped recesses in the foot. The recesses include clamping jaws bolted to a footplate having inwardly protruding cross-members. Nubs protruding at the underside of the clamping jaws press into the soft elastic material of the flange when the screws are tightened.

U.S. Pat. No. 6,109,820 to Hughes discloses a flexible marker assembly and base for traffic control markers or other purposes. The flexible marker assembly includes a substantially vertical flat marker mounted in a receptacle in a base. A first and second longitudinal arcuate surface is provided on a first and second side of the marker for supporting the flexible marker when the marker is bent, as may occur when the marker is impacted by a vehicle. The flat marker is inserted within a receptacle and is secured to the base by an anchor plate, which is either inserted within the receptacle or positioned below the base to engage the marker. The longitudinal arcuate surfaces have channels formed therein to allow access to fasteners, which connect the marker to an anchor plate.

U.S. Pat. No. 6,022,168 to Junker discloses an apparatus permitting guiding barriers resting on a street surface in the form of a track to be laterally shifted. The apparatus is fastened to a vehicle, and is moved along, together with the vehicle, in the longitudinal direction of the guiding barriers. The apparatus includes a guide way that has a curved portion extending behind the vehicle, such that a front portion of the guide way is laterally offset from a trailing portion thereof. The guide way has a generally U-shaped cross-section, upright legs of which guide the sides of the guiding barriers passing there through. A blade disposed at the front end of the guide way, initially moves under the first guiding barrier. The first guiding barrier and the subsequent barriers constituting the track are pushed over the guide way, into a position that is offset laterally to the original position, and placed down again on the surface of the street. When the end of the track which is to be shifted is reached by the moving apparatus, the guiding barriers are pulled over the guide way by the previously shifted portion of the track, which has already been brought into its new resting position on the street surface.

U.S. Pat. No. 6,402,422 to Gertz et al. discloses a vertical panel system having a vertical panel and a base. The vertical panel has one or more panels. Each panel has opposing first and second panel surfaces and a plurality of edges, wherein the plurality of edges has a base edge. A tab extends from the first panel base edge and terminates at a tab bottom edge. The tab has two opposing side surfaces extending between two opposing side edges. At least one of the tab side surfaces has a tab groove extending from the tab bottom edge and towards the first panel base edge. The base has a top surface and a slot extending from the top surface and into the base. The slot complements at least a portion of the tab and the tab groove. The tab bottom edge extends a length that is shorter than the length of the panel base edge. When assembled, a portion of the vertical panel is in contact with the base top surface, which stabilizes the vertical panel laterally. The edges of vertical panel are raised to protect the panel surfaces. The raised surfaces may have reflective sheeting disposed thereon or may comprise reflective material. There may also be a second panel in the vertical panel.

U.S. Pat. No. 6,659,681 to Kulp et al. discloses a vertical panel system comprising a vertical panel having a panel with opposing first and second panel surfaces and a base edge. The system further comprises a base having a slot for engaging the base edge of the panel. An aperture is disposed in the panel in proximity to the base edge, which is of sufficient size to receive a foot of a user, for assisting in the engagement of the panel and the base. The base for the vertical panel system comprises a center zone fabricated of vulcanized rubber, and an outer zone fabricated of recycled rubber. The slot is disposed in the center zone. Thus, the combination solves a need to be environmentally responsible and cost effective by recycling rubber which would otherwise fill our landfills, yet provides increased durability by using virgin vulcanized rubber in the zone of the base which includes the engagement slot.

U.S. Patent publication 20040076469 to Audet discloses a flexible parking post provided with an aluminum base, a flexible support and a rigid square tube which are mechanically fastened together, thus resulting in a durable device that may be used to easily display signs in parking lots or any other location. It can also be used to act as a barrier at the end of a parking space.

Although the traffic beacons of the prior art have obtained considerable success in the marketplace the traffic beacons of the prior art has suffered from certain deficiencies. In some instances, the signaling body would be decoupled from the holding device upon severe impact by a vehicle. Since many traffic beacons are not monitored by visual or electronic means, there was no way of ascertaining the absence of the signaling device. The absence of such a signaling device presents a substantial risk of accident and injury to vehicular traffic.

In addition, in some cases, the holding device was not of a sufficient height for deterring vehicles from intentionally crossing over the holding device. In other cases, the holding device was not of a sufficient height to meet legislated safety standards.

Therefore, it is an object of the present invention to provide a holding device for supporting a traffic beacon that having an improved holding device with an increased height.

Another object of this invention is to provide an improved holding device for supporting a traffic beacon that increases the height of the holding device without substantially increasing the weight of the holding device.

Another object of this invention is to provide an improved holding device for supporting a traffic beacon that incorporates a riser for increasing the height of the holding device that is integrally formed with the holding device.

Another object of this invention is to provide an improved holding device for supporting a traffic beacon that does not appreciably increase the cost of manufacture of the holding device.

The foregoing has outlined some of the more pertinent objects of the present invention. These objects should be construed as being merely illustrative of some of the more prominent features and applications of the invention. Many other beneficial results can be obtained by modifying the invention within the scope of the invention. Accordingly other objects in a full understanding of the invention may be had by referring to the summary of the invention and the detailed description describing the preferred embodiment of the invention.

SUMMARY OF THE INVENTION

A specific embodiment of the present invention is shown in the attached drawings. For the purpose of summarizing the invention, the invention relates to an improved holding device for supporting a traffic beacon comprising a longitudinal extending holding member having a first end and a second end. The longitudinal extending holding member has a bottom surface for resting on a generally flat surface. The longitudinal extending holding member has inclined opposed sidewalls meeting in a generally planar top surface. A coupling device is defined within the longitudinal extending holding member for securing a traffic beacon to the holding member. A riser has a riser lower region integrally formed upon the generally planar top surface and top upper region of the longitudinal extending holding member. The riser has a generally partially cylindrical riser region for raising the height of the improved holding device.

In a more specific embodiment of the invention, the holding member is formed from a polymeric material. The first end of a first longitudinal extending holding member is adapted to engage with a second end of a second longitudinal extending holding member for forming a continuous holding device unit. The first end the longitudinal extending holding member has a convex shape and the second end the longitudinal extending holding member having a concave shape. The first convex end of a first longitudinal extending holding member is adapted to engage with a second concave end of a second longitudinal extending holding member for forming a continuous holding device unit.

The opposed inclined sidewalls are angled upwardly and inwardly from the bottom surface. The longitudinal extending holding member defines a longitudinal extending holding member axis between the first and second ends of the longitudinal extending holding member. The coupling includes a transverse slot defined within the longitudinal extending holding member for supporting a vertically extending traffic beacon.

The foregoing has outlined rather broadly the more pertinent and important features of the present invention in order that the detailed description that follows may be better understood so that the present contribution to the art can be more fully appreciated. Additional features of the invention will be described hereinafter which form the subject matter of the invention. It should be appreciated by those skilled in the art that the conception and the specific embodiments disclosed maybe readily utilized as a basis for modifying or designing other structures for carrying out the same purposes of the present invention. It should also be realized by those skilled in the art that such equivalent constructions do not depart from the spirit and scope of the invention.

BRIEF DESCRIPTION OF THE DRAWINGS

For a fuller understanding of the nature and objects of the invention, reference should be made to the following detailed description taken in connection with the accompanying drawings in which.

Similar reference characters refer to similar parts throughout the several Figures of the drawings.

DETAILED DISCUSSION

Figure 1:
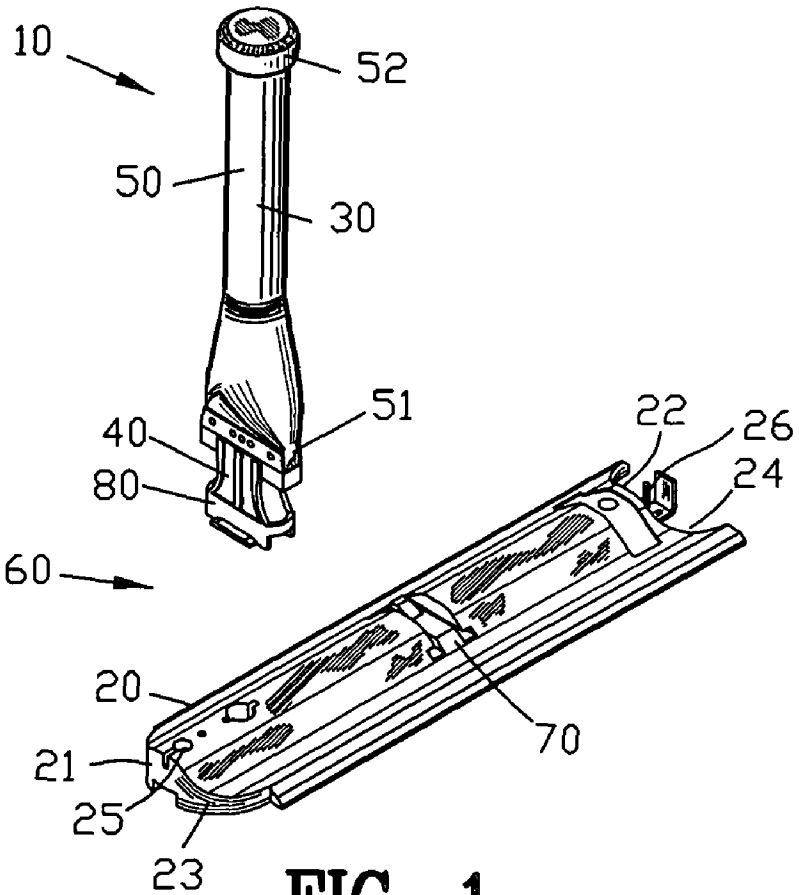
FIG. 1 is an isometric exploded view of a traffic beacon of the prior art illustrating a signaling body spaced apart from a holding device.

FIG. 1 is an isometric exploded view of a traffic beacon 10 of the prior art illustrating a holding device 20 spaced apart from a signaling body 30. In this example, the signaling body 30 comprises a lower portion 40 and an upper portion 50. The holding device 20 and signaling body 30 is similar to the several United States Patents granted to Junker including U.S. Pat. No. 5,168,827; U.S. Pat. No. 5,670,954 and U.S. Pat. No. 5,527,127.

Figure 5:
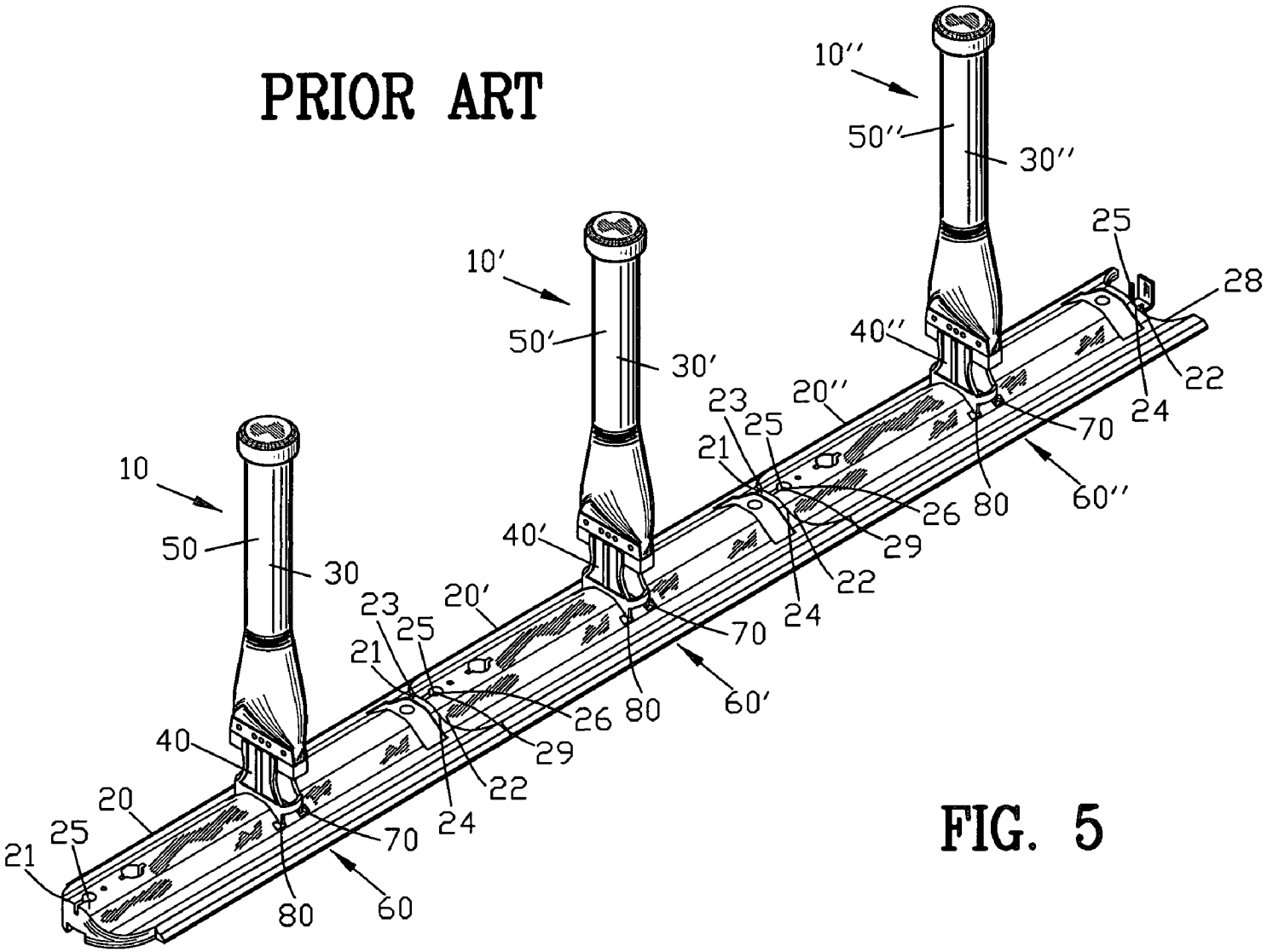
PRIOR ART FIG. 5
FIG. 5 is an isometric view illustrating a series of signaling bodies coupled to a series of holding devices.
Figure 6:
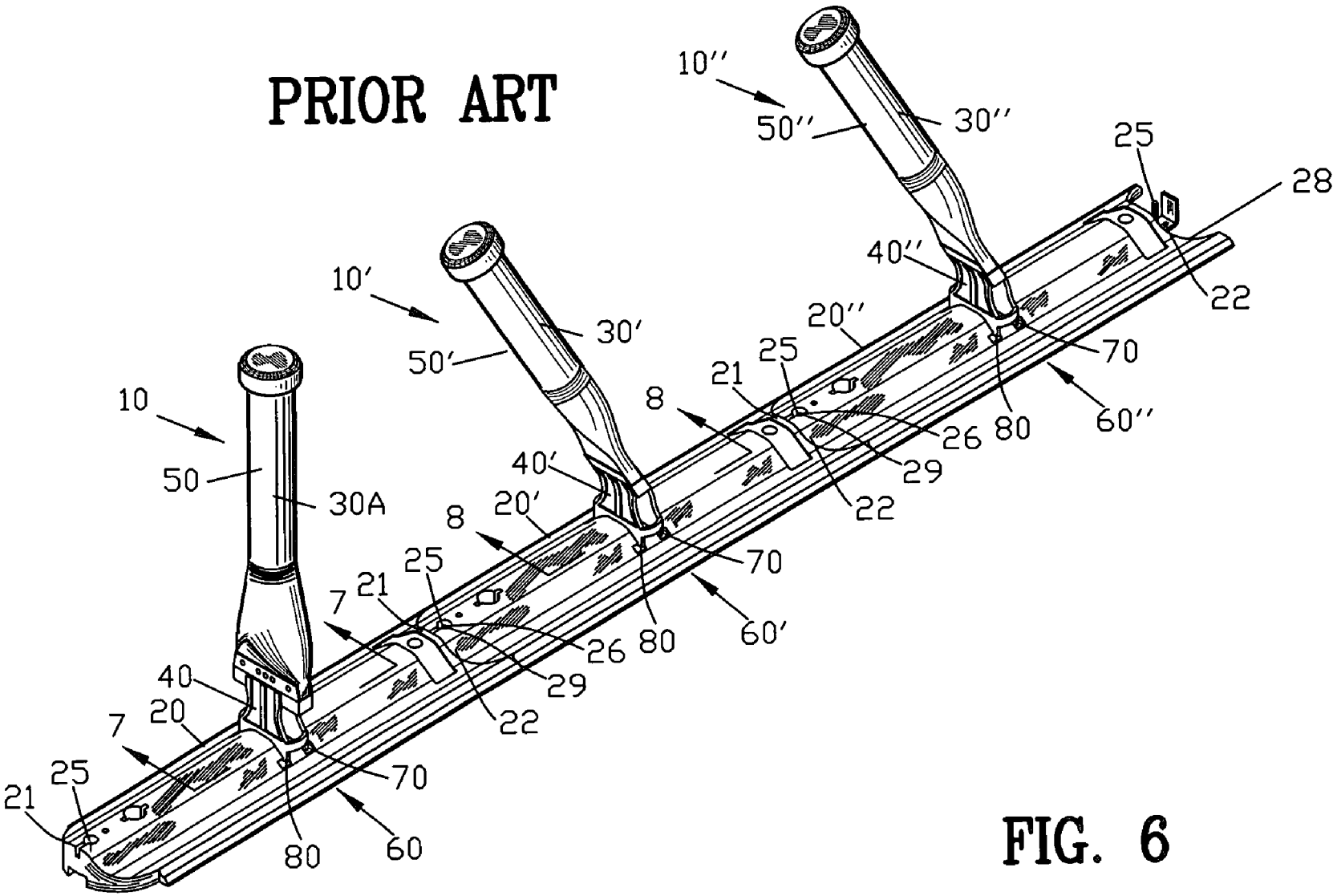
PRIOR ART FIG. 6
FIG. 6 is a view similar to FIG. 5 illustrating the deflection of the series of signaling bodies relative to the holding devices.

The holding device 20 extends between a first end 21 and a second end 22. In this example of the invention, the holding device 20 is formed from a polymeric material. The first end 21 of the holding device 20 has a generally convex shape 23 where the second end 22 of the holding device 20 has a generally concave shape 24. The first end 21 of the holding device 20 includes a mounting hole 25 whereas the second end 22 of the holding device 20 includes a mounting stud 26. The first and second ends 21 and 22 in combination with the mounting hole 25 and the mounting stud 26 enables a multiplicity of holding device 20 to be connected in series to form a continuous holding device unit as shown in FIGS. 5 and 6.

Figure 2:
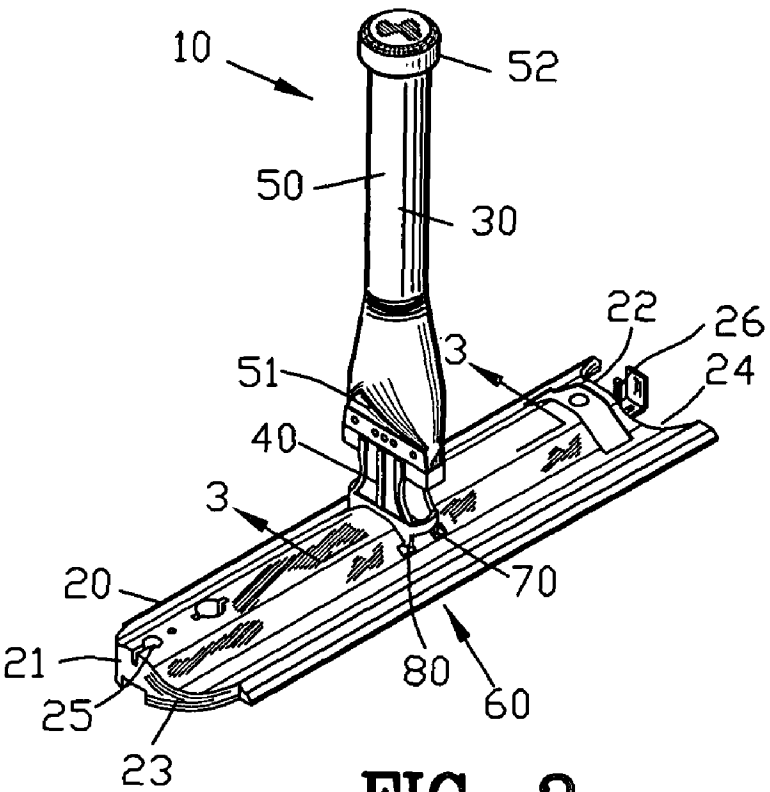
FIG. 2 PRIOR ART
FIG. 2 is a view similar to FIG. 1 illustrating the signaling body being coupled to the holding device.

FIG. 2 is a view similar to FIG. 1 illustrating the signaling body 30 being coupled to the holding device 20 through a coupling device 60. The coupling device 60 comprises a lower coupling member 70 defined by the holding device 20 and an upper coupling member 80 defined by the signaling body 30.

Figure 4:
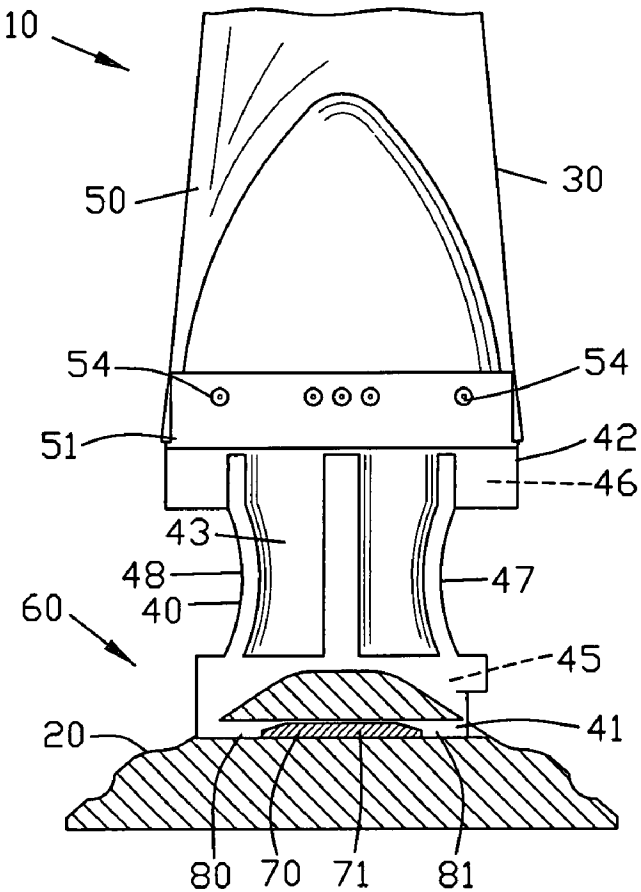
FIG. 4 PRIOR ART
FIG. 4 is a sectional view along line 4-4 in FIG. 3.
Figure 3:
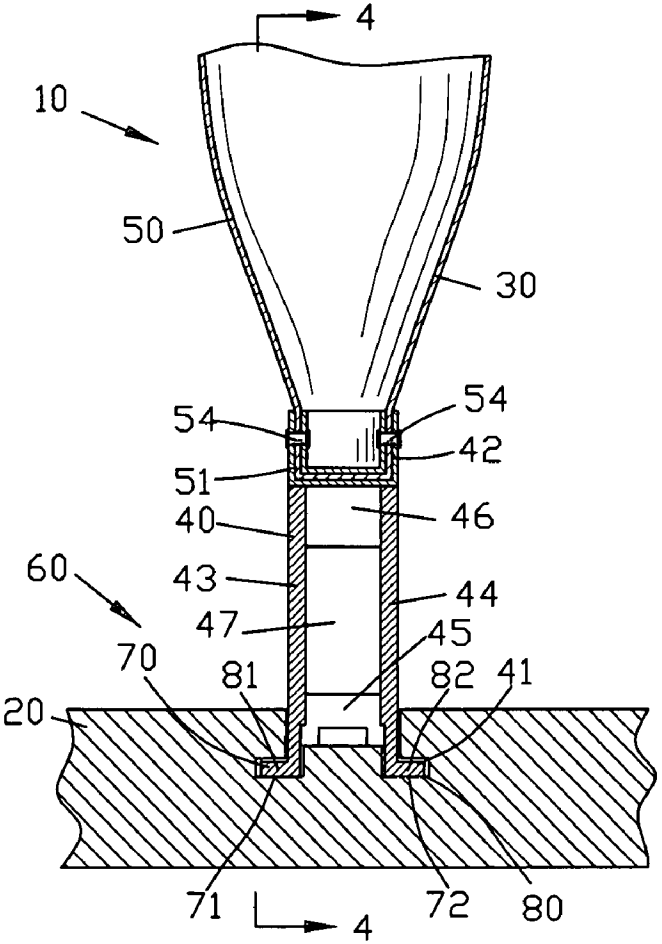
FIG. 3 is an enlarged sectional view along line 3-3 in FIG. 2.

FIGS. 3 and 4 are enlarged sectional views of FIG. 2 further illustrating the coupling of the signaling body 30 and the holding device 20. The lower portion 40 of the signaling body 30 is formed from a molded resilient material to extend between a first end 41 and a second end 42. The lower portion 40 comprises generally parallel walls 43 and 44 defining open portions 45 and 46. A first and a second end connector 47 and 48 interconnect the parallel walls 43 and 44 for adding mechanical strength between the open portions 45 and 46 located in proximity to the first and second ends 41 and 42. The parallel walls 43 and 44 in combination with the molded resilient material enable the lower portion 40 of the signaling body 30 to undergo substantial deflection upon impact by a vehicle.

The upper portion 50 of the signaling body 30 extends between a first end 51 and a second end 52. The upper portion 50 of the signaling body 30 is formed from a molded pliable material to extend between a first end 51 and a second end 52. Preferably, the upper portion 50 is less resilient than the lower portion 40.

The second end 42 of the lower portion 40 is secured to the first end 51 of the upper portion 50 of the signaling body 30. Preferably, a plurality of mechanical fasteners 54 secure the lower portion 40 to the upper portion 50 of the signaling body 30.

The lower coupling member 70 defined by the holding device 20 is shown as transverse slots 71 and 72 whereas the upper coupling member 80 is shown as opposed flanges 81 and 82. The opposed flanges 81 and 82 are inserted into the transverse slots 71 and 72 for coupling the signaling body 30 to the holding device 20.

FIG. 5 is an isometric view illustrating a plurality of holding devices 20, 20' and 20" interconnected to form a continuous holding device unit 28. The concave shape 24 of the second end 22 of the holding device 20 receives the convex shape 23 of the first end 21 of the holding device 20'. The mounting stud 26 of the holding device 20 extends through the mounting hole 25 of the holding device 20'. A nut 29 threadably engages with the mounting stud 26 for affixing the holding device 20 to the holding device 20'.

Similarly, the concave shape 24 of the second end 22 of the holding device 20'receives the convex shape 23 of the first end 21 of the holding device 20". The mounting stud 26 of the holding device 20' extends through the mounting hole 25 of the holding device 20". A nut 29 threadably engages with the mounting stud 26 for affixing the holding device 20' to the holding device 20". The concave shape 24 of the second end 22 of the holding devices 20, 20' and 20" cooperate with the convex shape 23 of the first end 21 of the holding devices 20, 20' and 20" to enable the continuous holding device unit 28 to extend along a serpentine path.

A plurality of signaling bodies 30, 30' and 30" are coupled to the holding devices 20, 20' and 20" forming the continuous holding device unit 28. Each of the plurality of signaling bodies 30, 30' and 30" are coupled to the holding devices 20, 20' and 20' by the coupling devices 60, 60' and 60" as described heretofore with reference to FIGS. 4 and 5.

FIG. 6 is a view similar to FIG. 5 illustrating the deflection of the signaling bodies 30' and 30" relative to the holding devices 20, 20' and 20". The pliable material of the upper portions 50, 50' and 50" in combination with the resiliency of the lower portions 40, 40' and 40" of the signaling bodies 30, 30' and 30" prevent damage to a vehicle in the event a vehicle collides with the traffic beacons 10, 10' and 10".

Figure 7:
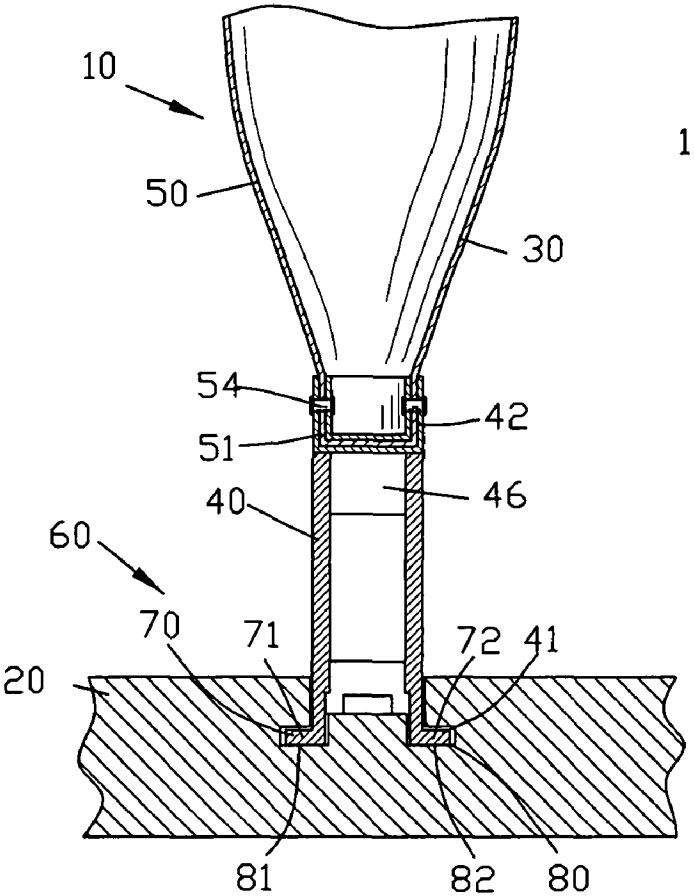
FIG. 7 is an enlarged sectional view along line 7-7 in FIG. 6.

FIG. 7 is an enlarged sectional view of the traffic beacon 10 of FIG. 6. The lower portion 40 of the signaling body 30 enables deflection of the entire signaling body 30 to prevent damage to a vehicle. The resilience of the lower portion 40 enables a vehicle to run over the traffic beacon 10. After the collision, the resilience of the lower portion 40 normally returns the signaling body 30 to an upright vertical condition.

Figure 8:
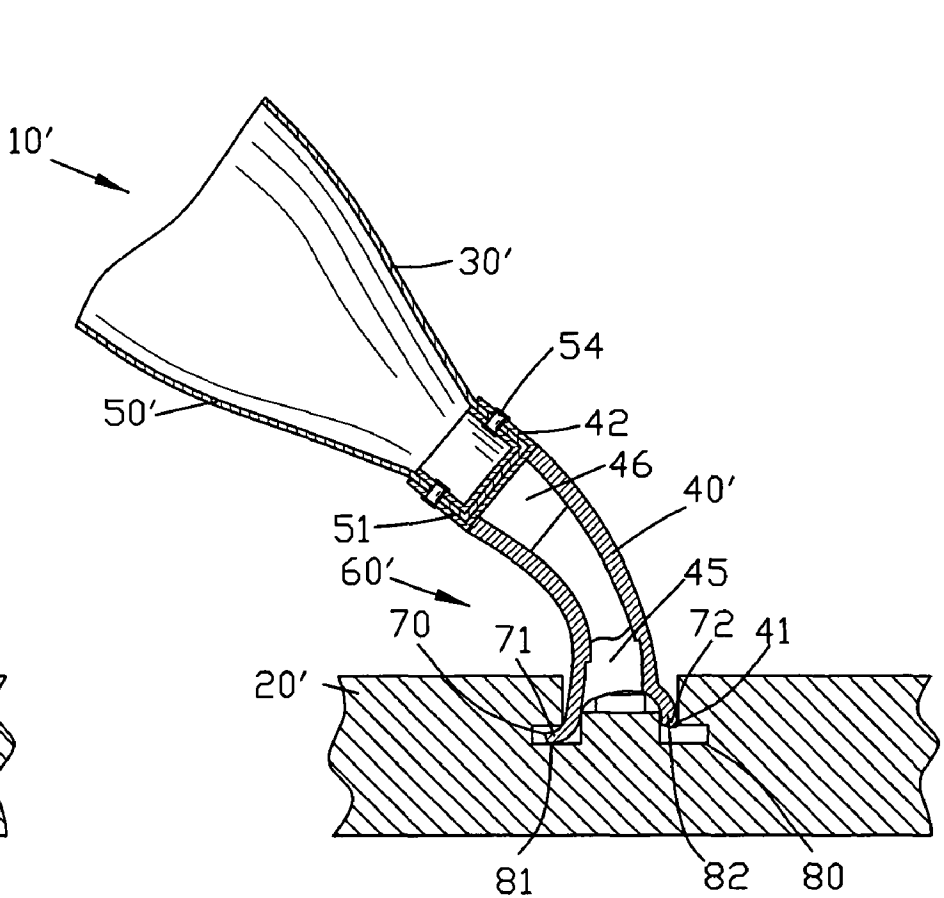
FIG. 8 PRIOR ART
FIG. 8 is an enlarged sectional view along line 8-8 in FIG. 6.

FIG. 8 is an enlarged sectional view of the deflected traffic beacon 10' of FIG. 6. In some circumstances, the impact of the collision by a vehicle displaced one or both of the opposed flanges 81 and 82 from the transverse slots 71 and 72 of the holding device 20'. In this example, the impact of the collision by a vehicle has displaced the flange 82 from the transverse slot 72 of the holding device 20'. Typically, a second impact by a vehicle will completely decouple the signaling body 30' from the holding device 20'.

Figure 9:
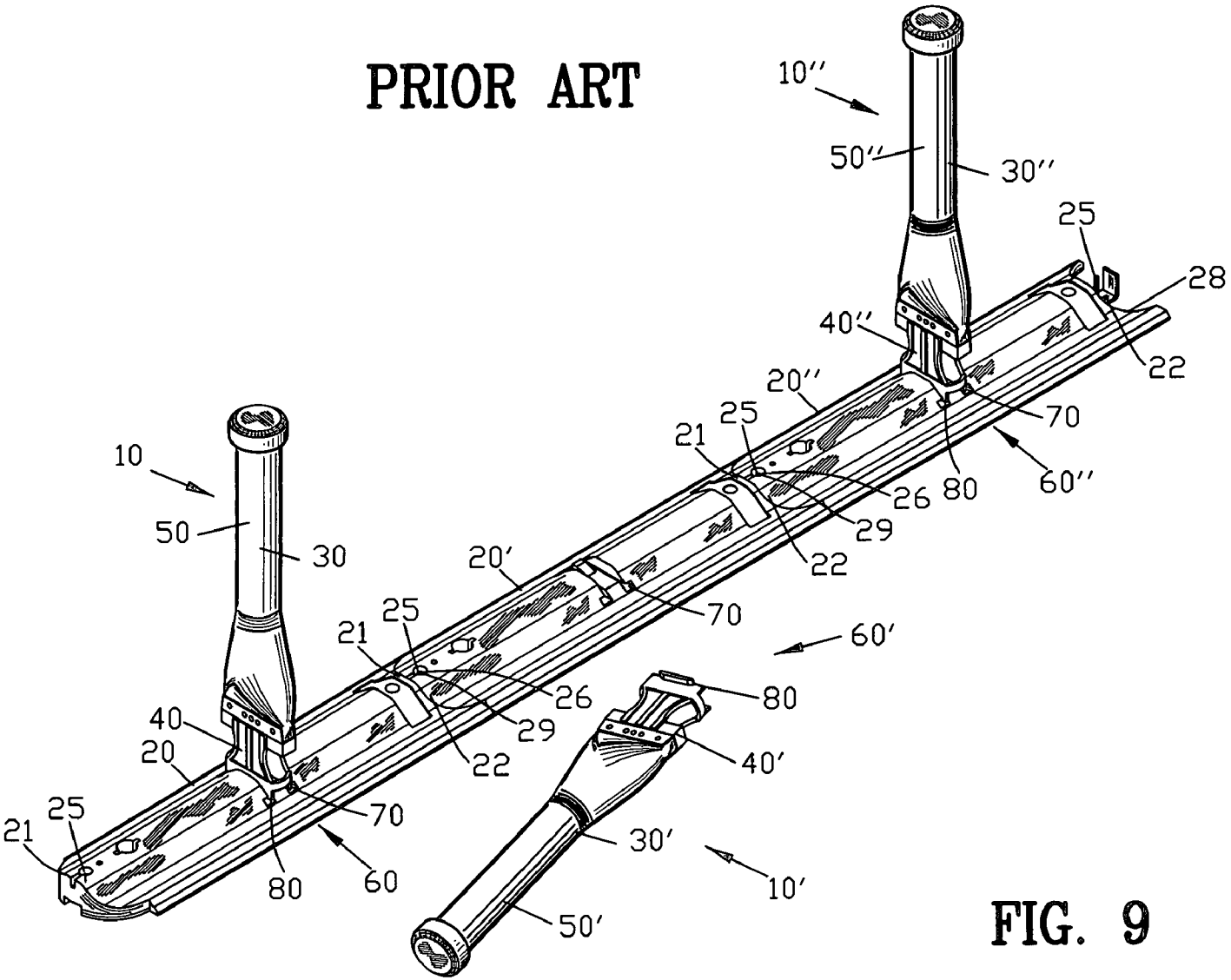
PRIOR ART FIG. 9
FIG. 9 is a view similar to FIG. 6 illustrating the decoupling of one of the series of signaling bodies due to severe deflection of the signaling body relative to the holding device.

FIG. 9 is a view similar to FIG. 6 illustrating the decoupling of the signaling body 30' due to a severe deflection of the signaling body 30' relative to the holding device 20'. The absence of such the signaling body 10' presents a substantial risk of accident and injury to vehicular traffic.

Figure 10:
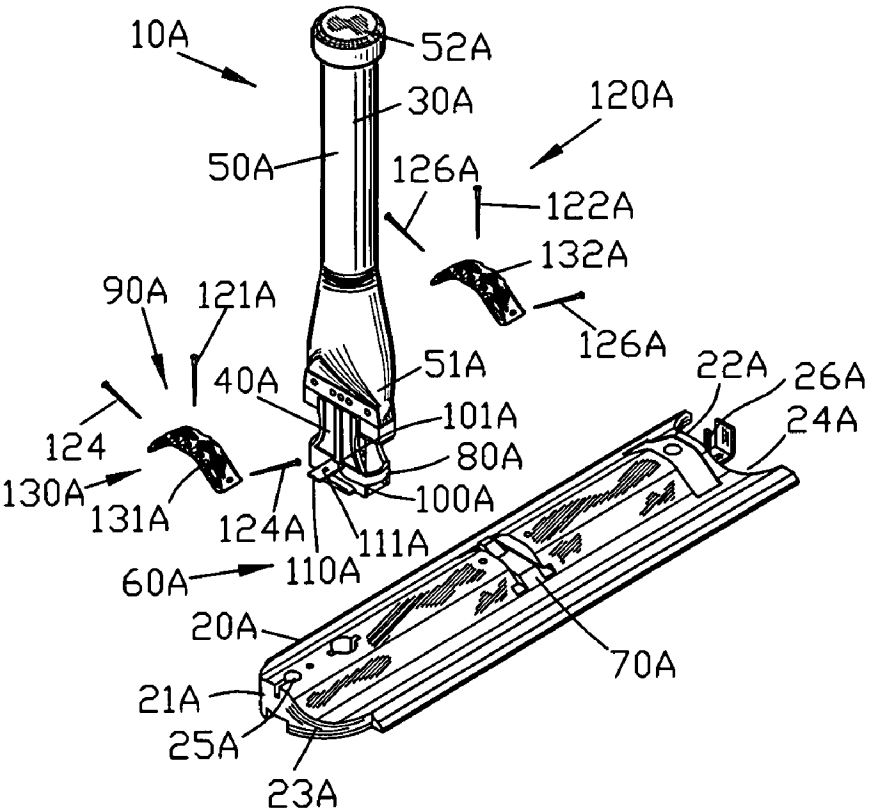
FIG. 10 is an isometric exploded view of the first embodiment of a traffic beacon illustrating a signaling body spaced apart from a holding device.

FIG. 10 is an isometric exploded view of a first embodiment of an improved traffic beacon 10A incorporating illustrating the signaling body 30A being spaced apart from the holding device 20A. The holding device 20A, the signaling body 30A and the coupling device 60A are identical to the same shown in FIGS. 1-9.

Figure 11:
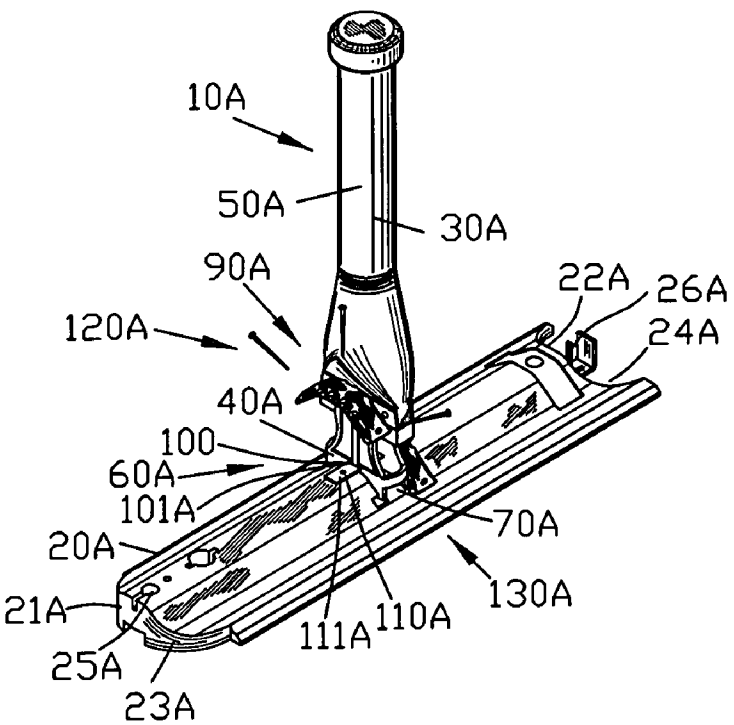
FIG. 11 is a view similar to FIG. 8 illustrating the signaling body being coupled to the holding device.

FIG. 11 is a view similar to FIG. 10 illustrating the signaling body 30A being coupled to the holding device 20A through a coupling device 60A in a manner identical to FIG. 2. The upper coupling member 80A defined by the signaling body 30A is inserted into the lower coupling member 70A defined by the holding device 20A.

Figure 12:
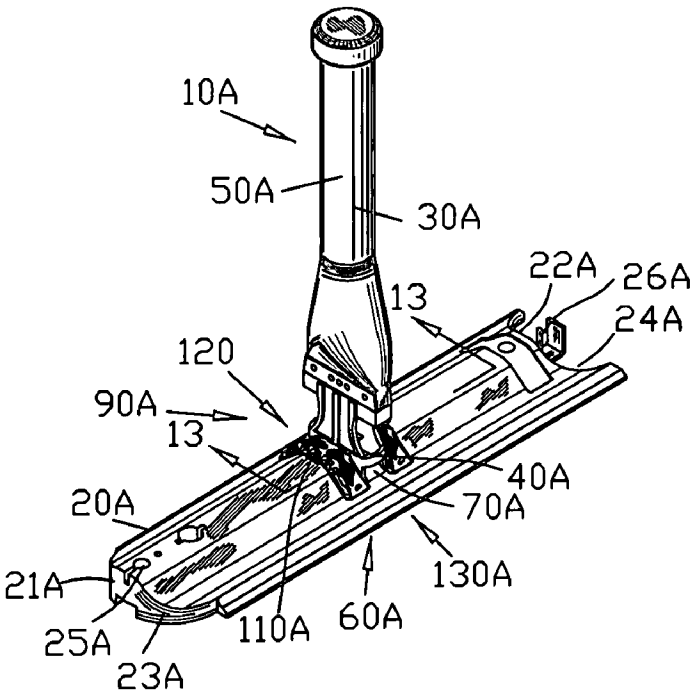
FIG. 12 is a view similar to FIG. 11 illustrating the signaling body being locked to the holding device.

FIG. 12 is a view similar to FIG. 11 illustrating the signaling body 30A being locked to the holding device 20A. In this embodiment, the lower portion 40A of the signaling body 30A is provided with a locking device 90A.

Figure 13:
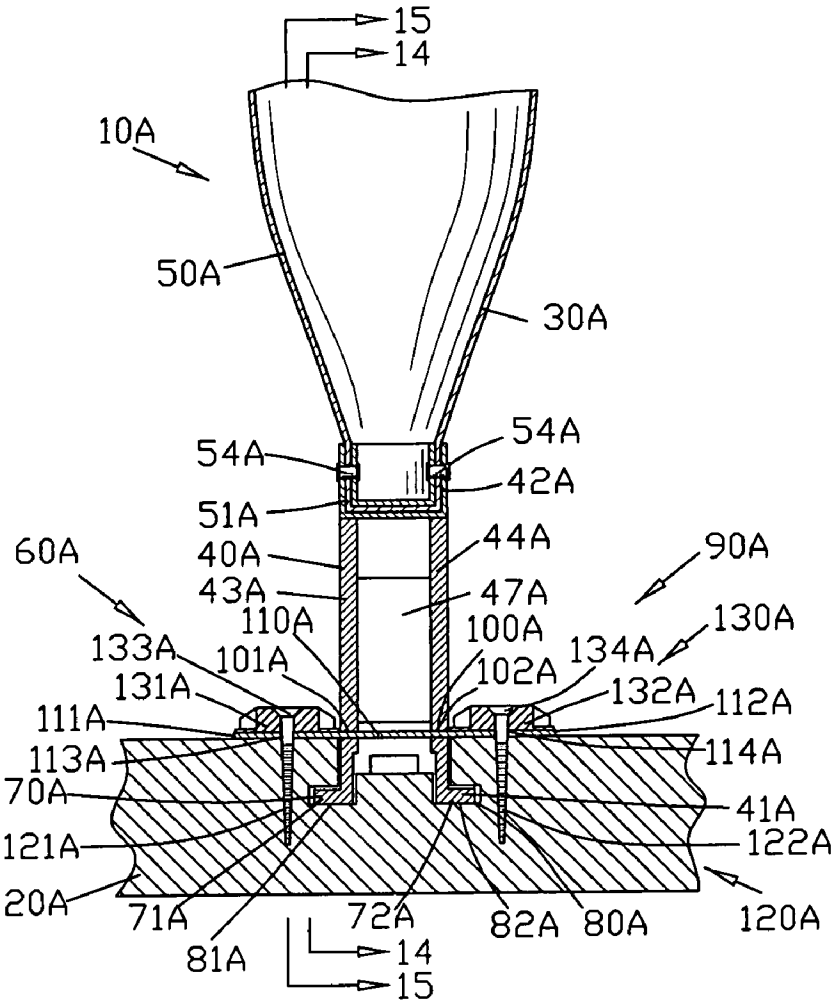
FIG. 13 is an enlarged sectional view along line 13-13 in FIG. 12.
Figure 15:
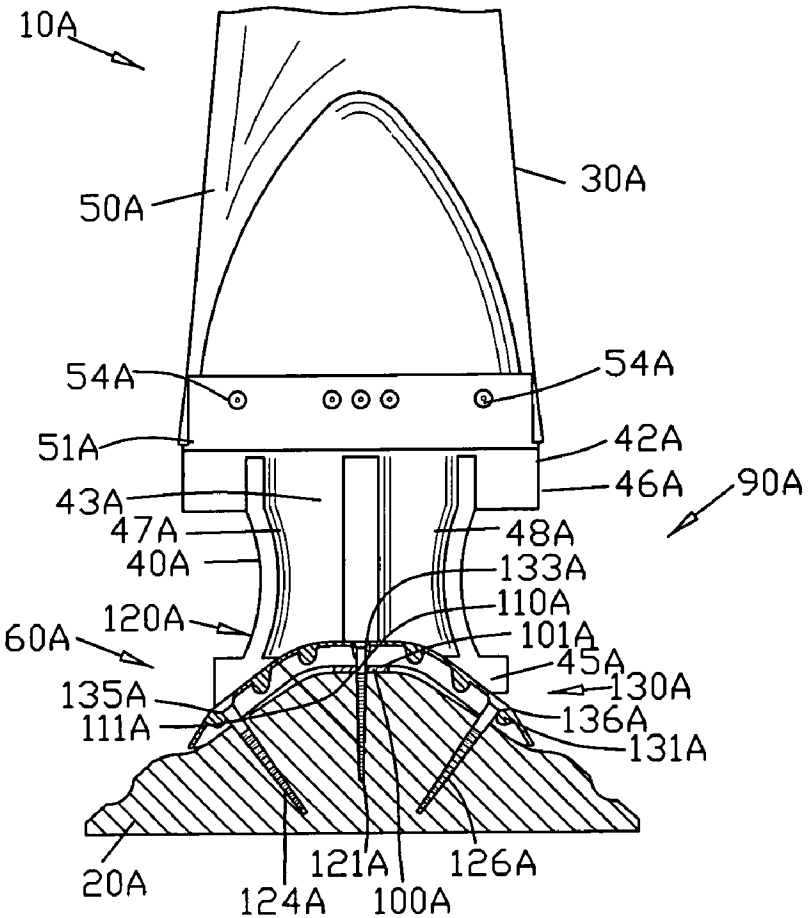
FIG. 15 is a sectional view along line 15-15 in FIG. 13.
Figure 14:
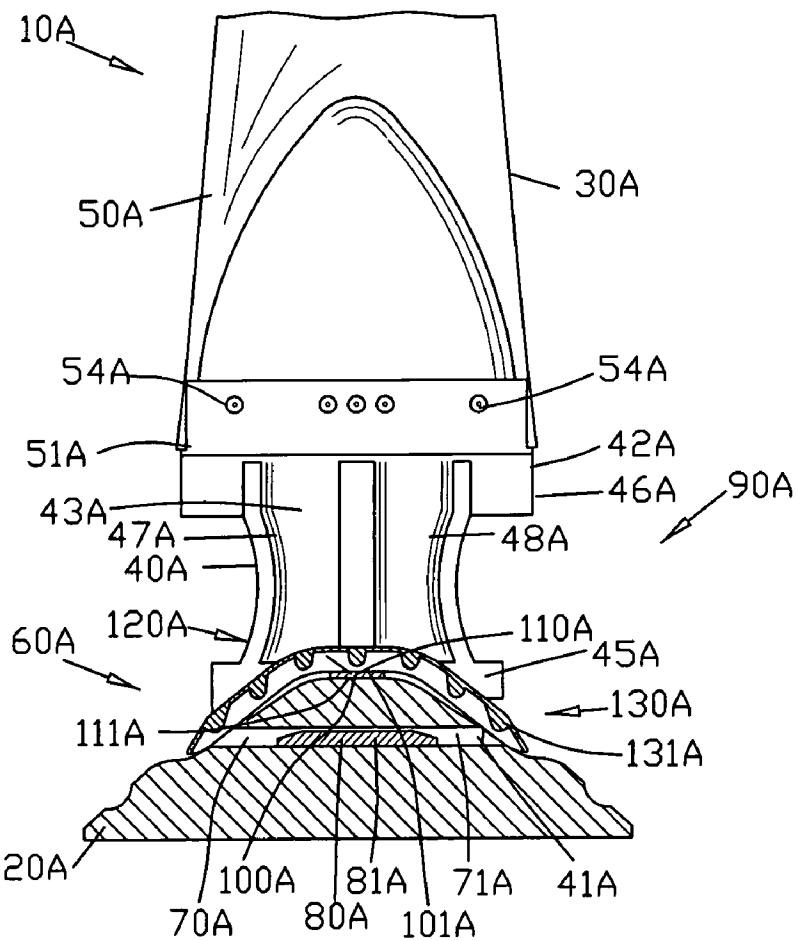
FIG. 14 is a sectional view along line 14-14 in FIG. 13.

FIGS. 13-15 are enlarged sectional views of FIG. 12 further illustrating the locking device 90A. The locking device 90A includes a slit 100A comprising a first and a second slit 101A and 102A defined in the parallel walls 43A and 44A of the lower portion 40A of the signaling body 30A. The locking device 90A further includes a locking bar 110A extending between a first and a second end 111A and 112A. The first and second ends 111A and 112A of the locking bar 110A define a first and a second locking bar aperture 113A and 114A. Preferably, the locking bar 110A comprises a metallic locking bar such as a metallic strap.

The first and second ends 111A and 112A of the locking bar 110A extend on opposed sides of the coupling device 60A. The locking bar 110A extends through the first and second slits 101A and 102A located in the parallel walls 43A and 44A of the lower portion 40A of the signaling body 30A. The first and second ends 111A and 112A of the locking bar 110A extend beyond the parallel walls 43A and 44A of the lower portion 40A of the signaling body 30A. Preferably, the first and second slits 101A and 102A are dimensioned to resiliently retain the locking bar 110A within the lower portion 40A of the signaling body 30A.

The locking device 90A comprises a fastener device 120A for fastening the locking bar 110A to the holding device 20A. In this example, the fastener device 120A comprises a first and a second screw 121A and 122A extending through the first and second locking bar apertures 113A and 114A and threadably engaging with the holding device 20A to secure the locking bar 110A to the holding device 20A. The first and second screws 121A and 122A threadably engage into the polymeric material of the holding device 20A.

In this embodiment, the locking device 90A comprises a keeper 130A for overlaying a portion of the locking bar 110A. In this example, the keeper 130A comprises a first and a second keeper 131A and 132A defining a first and a second keeper aperture 133A and 134A. The first and second keepers 131A and 132A overlay the first and second ends 111A and 112A of the locking bar 110A.

The first and second screws 121A and 122A extend through the first and second keeper apertures 133A and 134A and the first and second locking bar apertures 111A and 112A to threadably engage into the polymeric material of the holding device 20A to secure the locking bar 110A to the holding device 20A.

The first and second keepers 131A and 132A define first and second secondary keeper apertures 135A and 136A. A first and a second secondary screw 124A and 126A extend through the first and second secondary keeper apertures 135A and 136A to threadably engage into the polymeric material of the holding device 20A. The first and second secondary screws 124A and 126A further secure the first and second keepers 131A and 132A to the holding device 20A.

Figure 16:
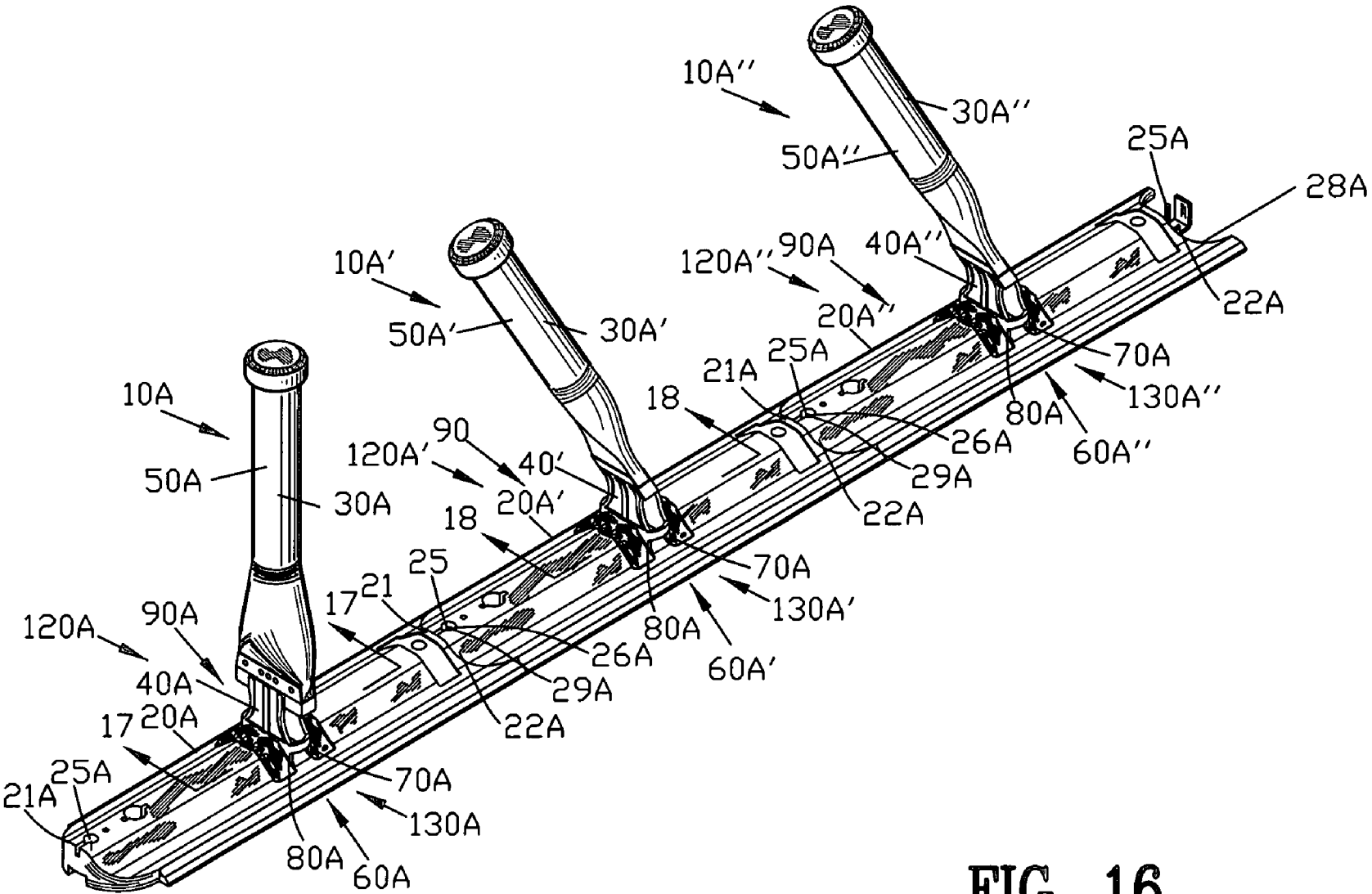
FIG. 16 is an isometric view illustrating a series of signaling bodies of FIG. 12 locked to a series of holding devices with the signaling bodies being deflected relative to the holding devices.

FIG. 16 is an isometric view illustrating a series of signaling bodies 30A, 30A and 30A" of FIG. 12 locked to a series of holding devices 20A, 20A' and 20A" with the signaling bodies 30A' and 30A" being deflected relative to the holding devices 20A' and 20A". The pliable material of the upper portion 50A in combination with the resiliency of the lower portion 40A of the signaling body 30A prevents damage to a vehicle in the event a vehicle collides with the traffic beacon 10A, 10A' and 10A".

Figure 17:
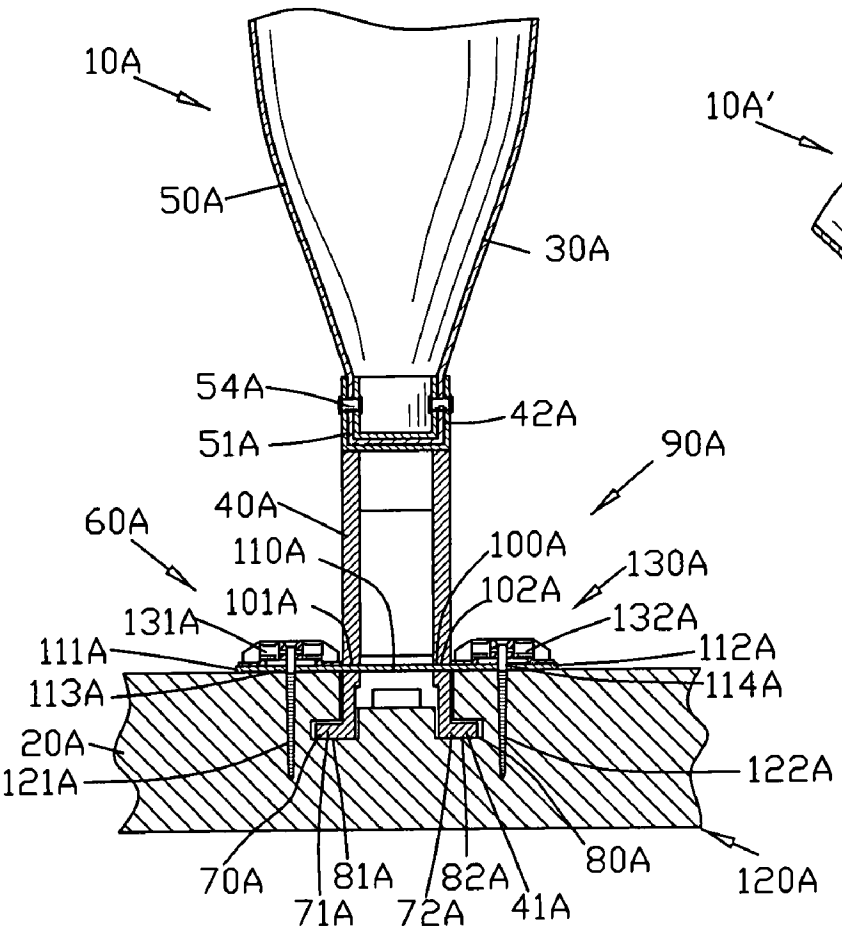
FIG. 17 is an enlarged sectional view along line 17-17 in FIG. 16.

FIG. 17 is an enlarged sectional view of the traffic beacon 10A of FIG. 16. The traffic beacon 10A is shown in a non-deflected condition. The lower portion 40A of the signaling body 30A enables deflection of the entire signaling body 30A to prevent damage to a vehicle. The resilience of the lower portion 40A enables a vehicle to run over the traffic beacon 10A. After the collision, the resilience of the lower portion 40A normally returns the signaling body 30A to an upright vertical condition.

Figure 18:
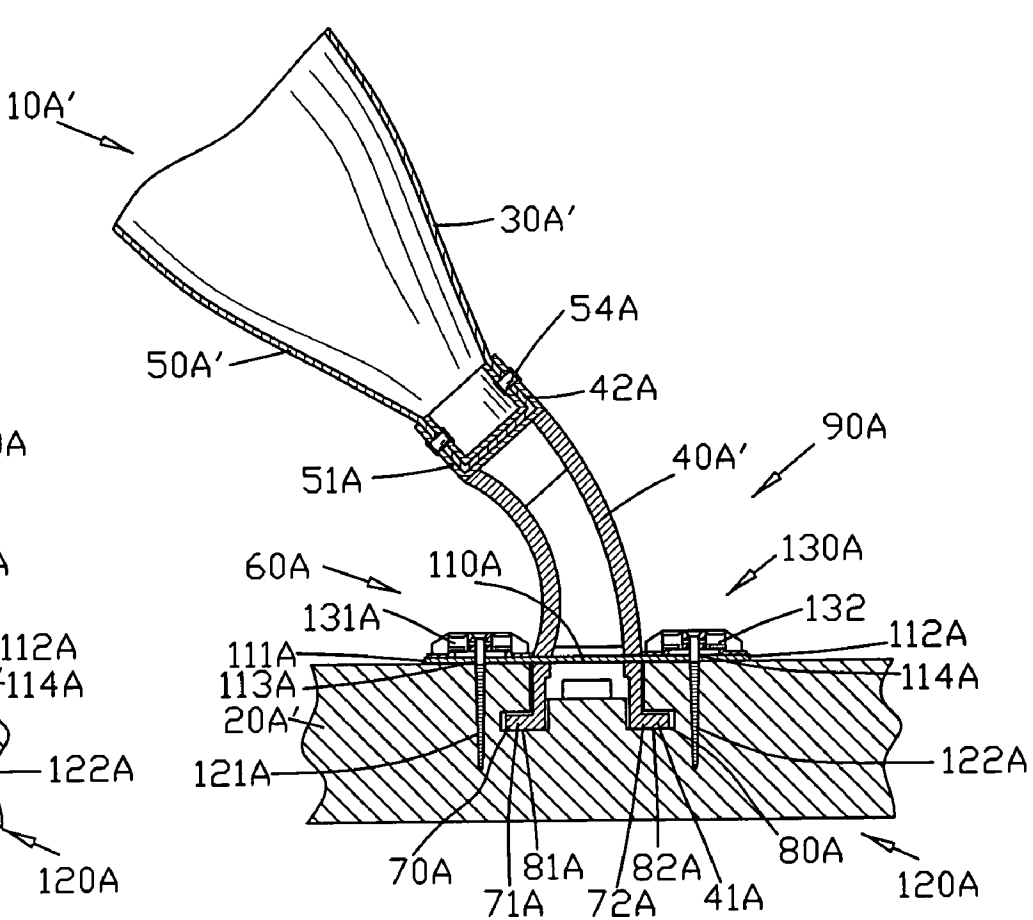
FIG. 18 is an enlarged sectional view along line 18-18 in FIG. 16.

FIG. 18 is an enlarged sectional view of the deflected traffic beacon 10A of FIG. 16. The impact of the collision by a vehicle deflected the traffic beacon 10A' relative to the holding device 20A'. The locking device 90A prevents displacement of the opposed flanges 81A and 82A from the transverse slots 71A and 72A of the holding device 20A'. In contrast to the prior art shown in FIG. 8, an impact of the collision by a vehicle does not displace the flange 82A from the transverse slot 72A of the holding device 20A'.

Figure 19:
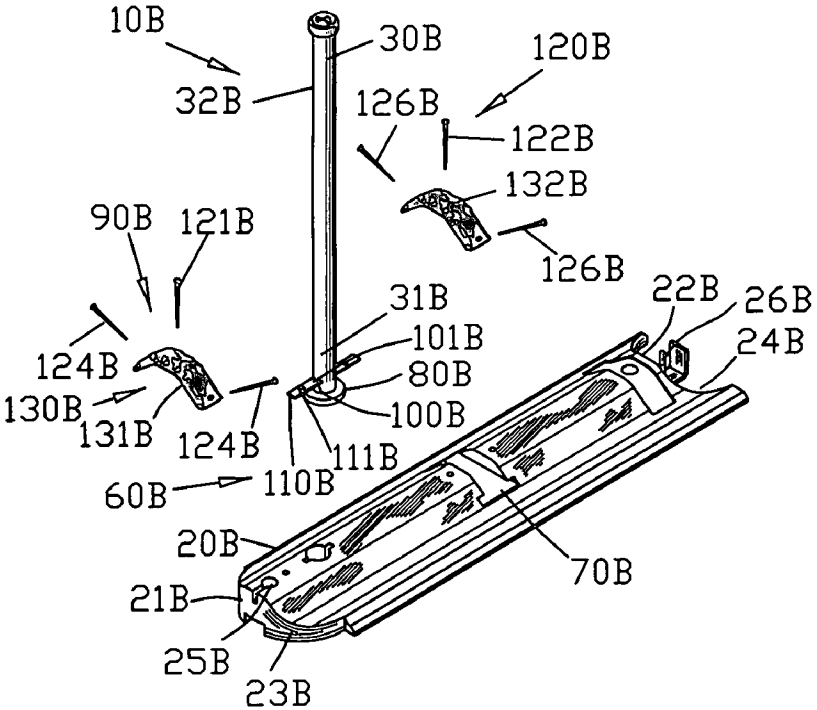
FIG. 19 is an isometric exploded view of a second embodiment of a traffic beacon illustrating a signaling body spaced apart from a holding device.

FIG. 19 is an isometric exploded view of a second embodiment of an improved traffic beacon 10B illustrating a signaling body 30B spaced apart from a holding device 20B. The holding device 20B, and the coupling device 60B are identical to those shown in FIGS. 1-9. In this example, the signaling body 30B is shown as a generally tubular signaling body 30B.

Figure 20:
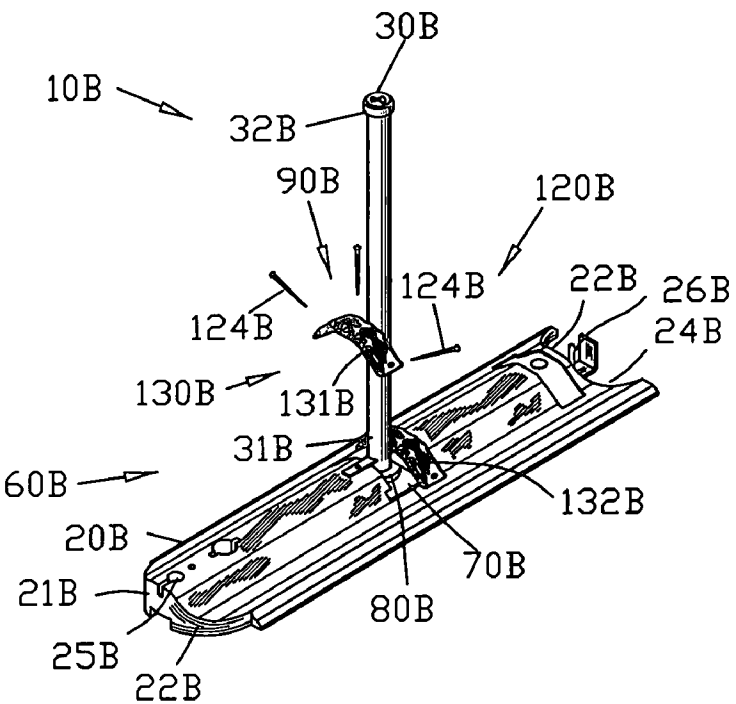
FIG. 20 is a view similar to FIG. 19 illustrating the signaling body being coupled to the holding device.

FIG. 20 is a view similar to FIG. 19 illustrating the signaling body 30B being coupled to the holding device 20B through a coupling device 60B in a manner identical to FIG. 2. The upper coupling member 80B defined by the signaling body 30B is inserted into the lower coupling member 70B defined by the holding device 20B.

Figure 21:
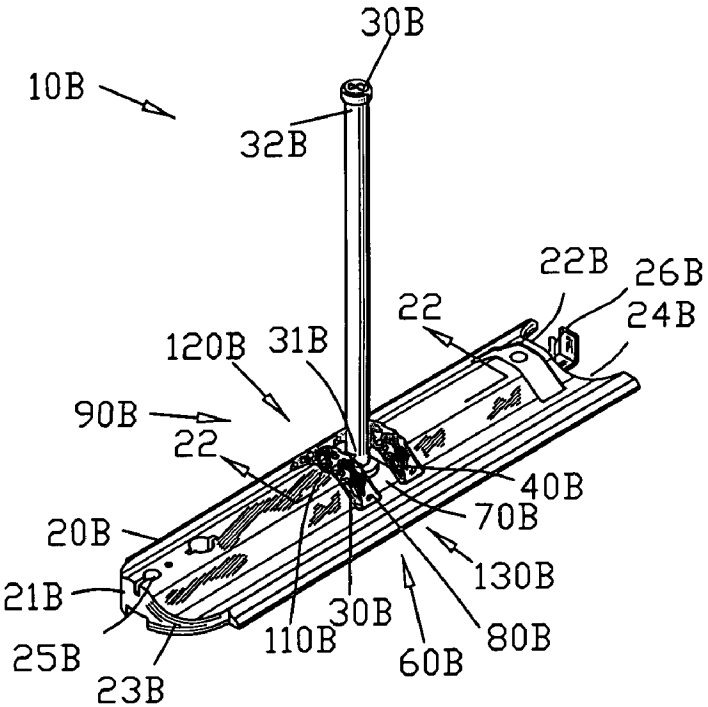
FIG. 21 is a view similar to FIG. 20 illustrating the signaling body being locked to the holding device.

FIG. 21 is a view similar to FIG. 20 illustrating the signaling body 30B being locked to the holding device 20B. In this embodiment, the signaling body 30B extends between a first and a second end 31B and 32B. The first end 31B of the signaling body 30B is provided with a locking device 90B.

Figure 22:
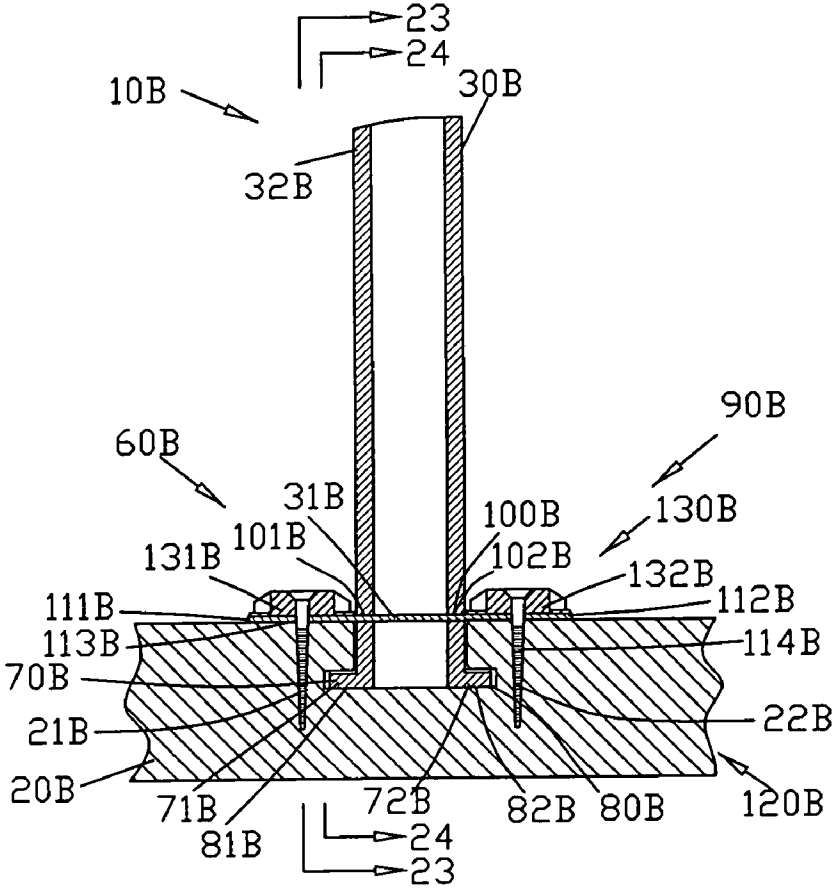
FIG. 22 is an enlarged sectional view along line 22-22 in FIG. 21.
Figure 24:
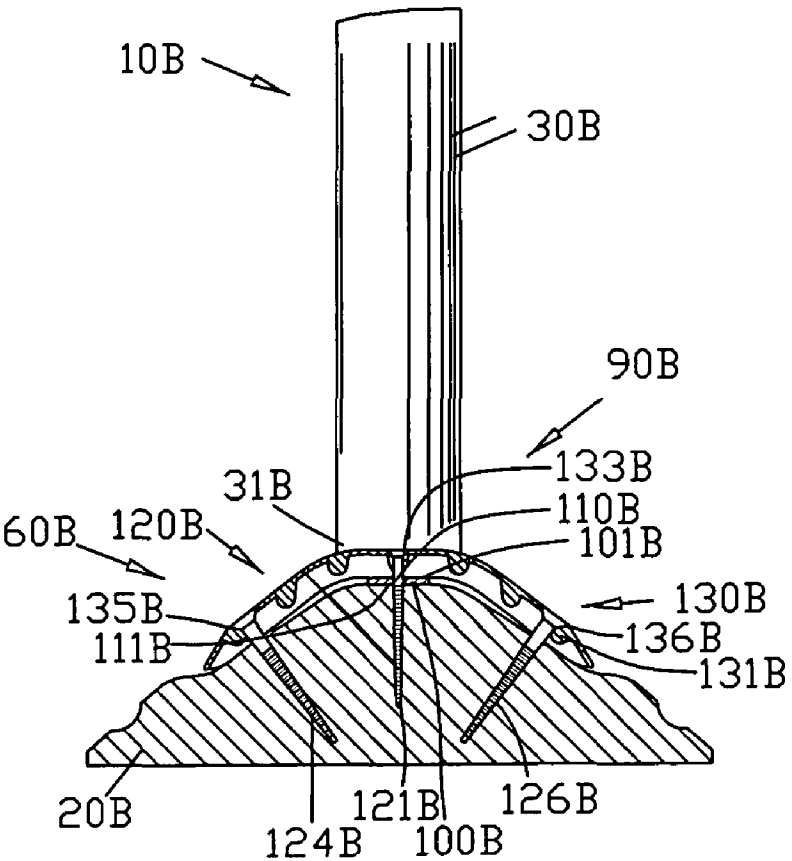
FIG. 24 is a sectional view along line 24-24 in FIG. 22.
Figure 23:
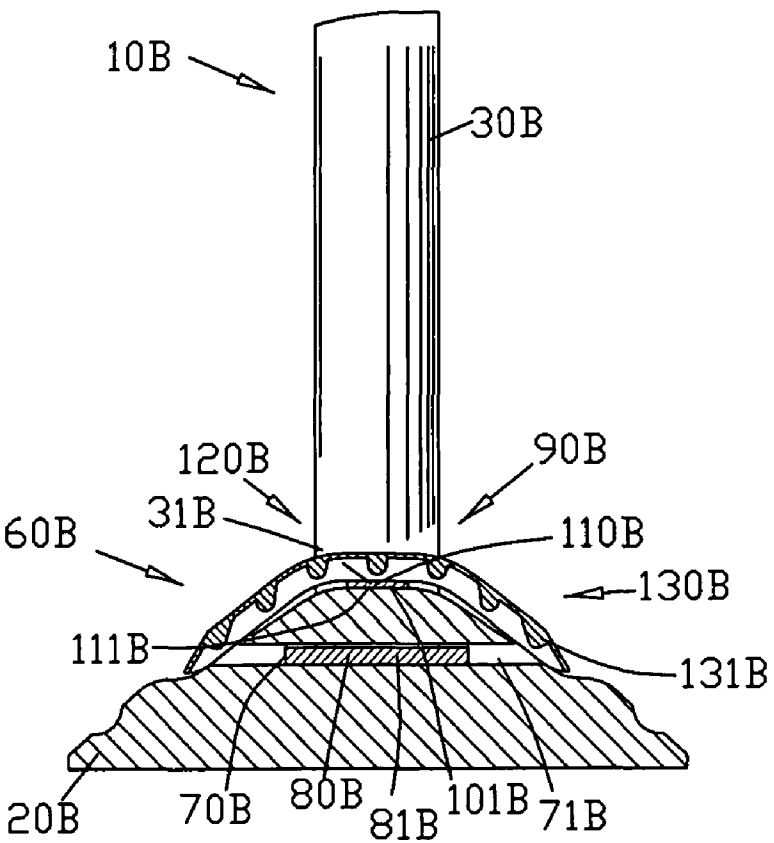
FIG. 23 is a sectional view along line 23-23 in FIG. 22.

FIGS. 22-24 are enlarged sectional views of FIG. 21 further illustrating the signaling body 30B locked to the holding device 20B. The lower coupling member 70B defined by the holding device 20B is shown as transverse slots 71B and 72B in a manner similar to FIGS. 10-18. In this example, the upper coupling member 80B is shown as circular flanges defining opposed flange portions 81B and 82B. The opposed flanges portions 81B and 82B are inserted into the transverse slots 71B and 72B for coupling the signaling body 30B to the holding device 20B.

The locking device 90B is identical to the locking device 90A shown in FIGS. 10-18. The locking device 90B includes a slit 100B comprising a first and a second slit 101B and 102B located at the first end 31B of the signaling body 30B. The locking device 90B further includes the locking bar 110B extending between a first and a second end 111B and 112B having first and second locking bar aperture 113B and 114B.

The locking bar 110B extends through the first and second slits 101B and 102B located first end 31B of the signaling body 30B. The first and second slits 101B and 102B are dimensioned to resiliently retain the locking bar 110B within the first end 31B of the signaling body 30B.

The locking device 90B comprises a fastener device 120B for fastening the locking bar 110B to the holding device 20A in a manner similar to FIGS. 13-15. The locking device 90B comprises a keeper 130B for overlaying a portion of the locking bar 110B in a manner similar to FIGS. 13-15. The keeper 130B comprising a first and a second keeper 131B and 132B are secured to the holding device 20B in a manner previously set forth herein.

Figure 26:
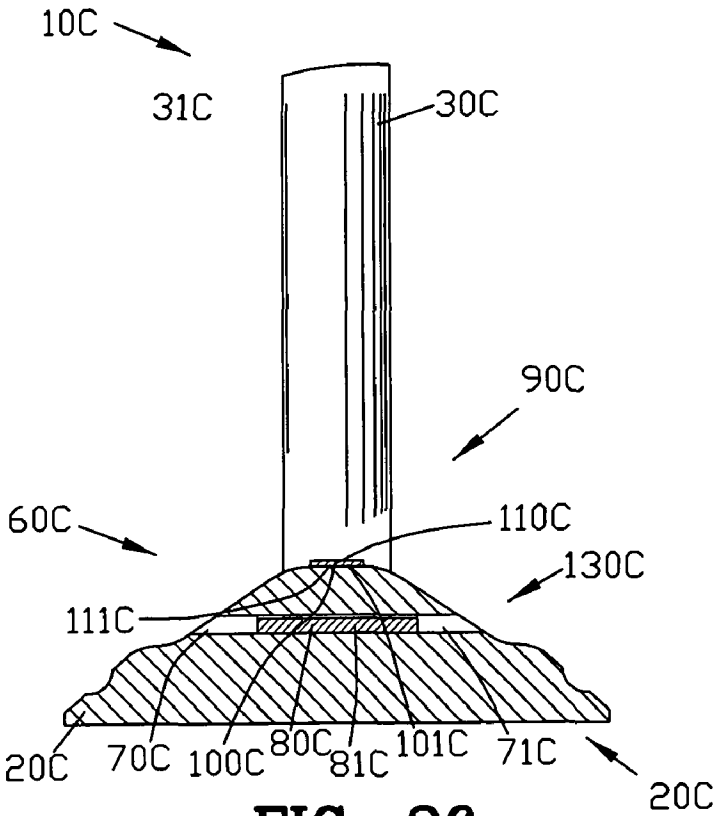
FIG. 26 is view similar to FIG. 23 illustrating the third embodiment of the traffic beacon of FIG. 25.
Figure 25:
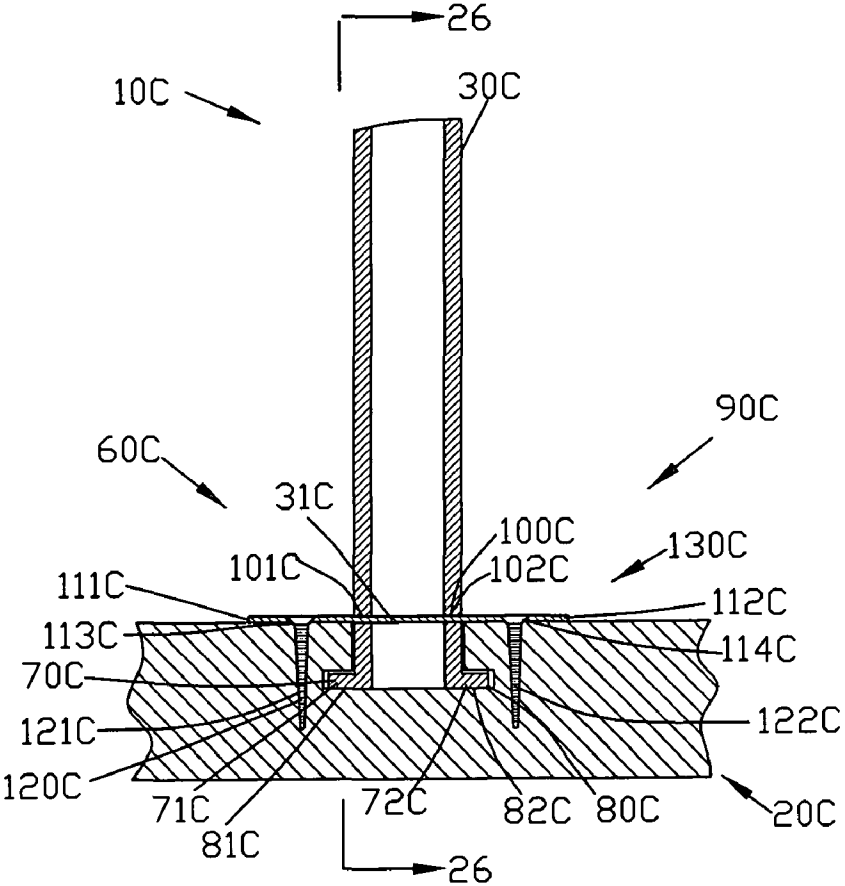
FIG. 25 is a view similar to FIG. 22 illustrating a third embodiment of the traffic beacon.

FIGS. 25 and 26 are views similar to FIGS. 22 and 23 illustrating a third embodiment of the improved traffic beacon 10C illustrating the signaling body 30C locked to the holding device 20C. The signaling body 30C is shown as a generally tubular signaling body 30C extending between a first and a second end 31C and 32C in a manner similar to FIGS. 19-24. The lower coupling member 70C defined by the holding device 20C is shown as transverse slots 71C and 72C in a manner similar to FIGS. 10-18.

The upper coupling member 80C is shown as circular flanges defining opposed flange portions 81C and 82C. The opposed flanges portions 81C and 82C are inserted into the transverse slots 71C and 72 for coupling the signaling body 30C to the holding device 20C.

The first end 31C of the signaling body 30C is provided with a locking device 90C. The locking device 90C includes a slit 100C comprising a first and a second slit 101C and 102C located at the first end 31C of the signaling body 30C. The locking device 90C further includes the locking bar 110C extending between a first and a second end 111C and 112C having first and second locking bar aperture 113C and 114C.

The locking bar 110C extends through the first and second slits 101C and 102C located at the first end 31C of the signaling body 30C. The first and second slits 101C and 102C are dimensioned to resiliently retain the locking bar 110C within the first end 31C of the signaling body 30C.

The locking device 90C comprises a fastener device 120C for fastening the locking bar 110C to the holding device 20C in a manner similar to FIGS. 13-15. In this embodiment, the locking device 90C does not utilize a keeper 130B as shown in FIGS. 9-24.

FIGS. 27-35 illustrate a fourth embodiment of the improved traffic beacon 10D illustrating the signaling body 30D locked to the holding device 20D. The fourth embodiment of the invention shown in FIGS. 27-35 has significant advancements over the prior embodiments.

Figure 27:
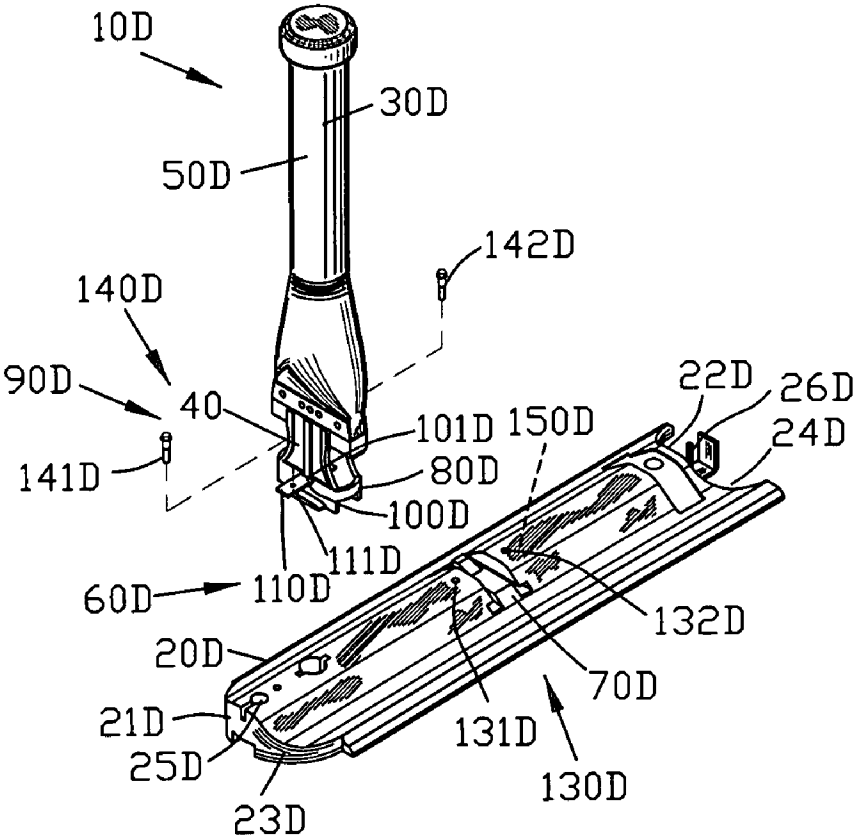
FIG. 27 is an isometric exploded view of the fourth embodiment of a traffic beacon illustrating a signaling body spaced apart from a holding device.

FIG. 27 is an isometric exploded view of the fourth embodiment of the improved traffic beacon 10D incorporating illustrating the signaling body 30D being spaced apart from the holding device 20D. The holding device 20D, the signaling body 30D and the coupling device 60D are identical to those shown in FIGS. 10-18.

Figure 28:
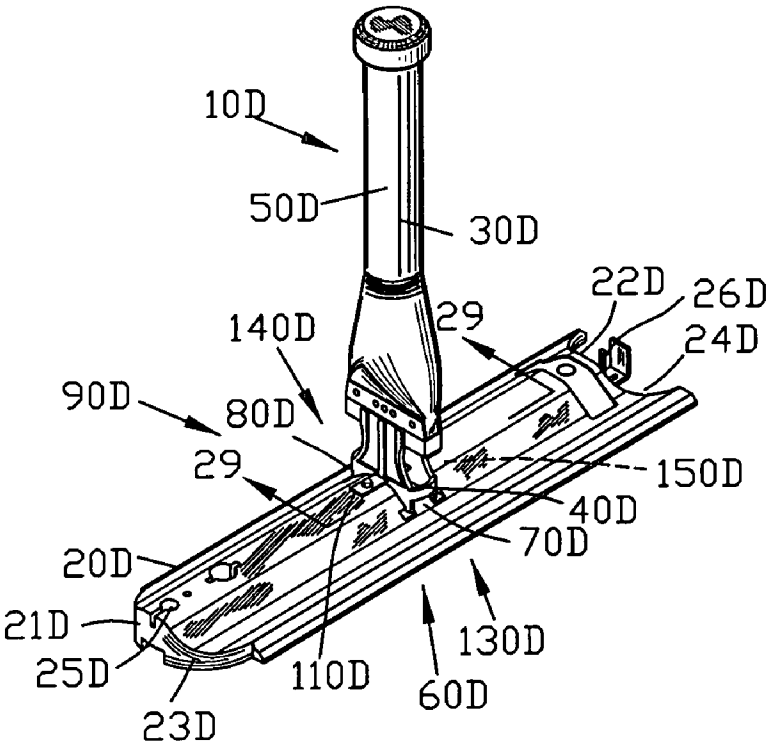
FIG. 28 is a view similar to FIG. 27 illustrating the signaling body being locked to the holding device.

FIG. 28 is a view similar to FIG. 11 illustrating the signaling body 30D being coupled to the holding device 20D through a coupling device 60D in a manner identical to FIG. 2. The upper coupling member 80D defined by the signaling body 30D is inserted into the lower coupling member 70D defined by the holding device 20D. The signaling body 30D is locked to the holding device 20D by a locking device 90D.

FIGS. 29-32 are enlarged views of FIG. 28 further illustrating the locking device 90D. The locking device 90D includes a slit 100D comprising a first and a second slit 101D and 102D defined in the parallel walls 43D and 44D of the lower portion 40D of the signaling body 30D. The locking device 90D further includes a locking bar 110D extending between a first and a second end 111D and 112D. The first and second ends 111D and 112D of the locking bar 110D define a first and second locking bar aperture 113D and 114D. Preferably, the locking bar 110D comprises a metallic locking bar such as a metallic strap.

The first and second ends 111D and 112D of the locking bar 110D extend on opposed sides of the coupling device 60D. The locking bar 110D extends through the first and second slits 101D and 102D located in the parallel walls 43D and 44D of the lower portion 40D of the signaling body 30D. The first and second ends 111D and 112D of the locking bar 110D extend beyond the parallel walls 43D and 44D of the lower portion 40D of the signaling body 30D. Preferably, the first and second slits 101D and 102D are dimensioned to resiliently retain the locking bar 110D within the lower portion 40D of the signaling body 30D.

Figure 30:
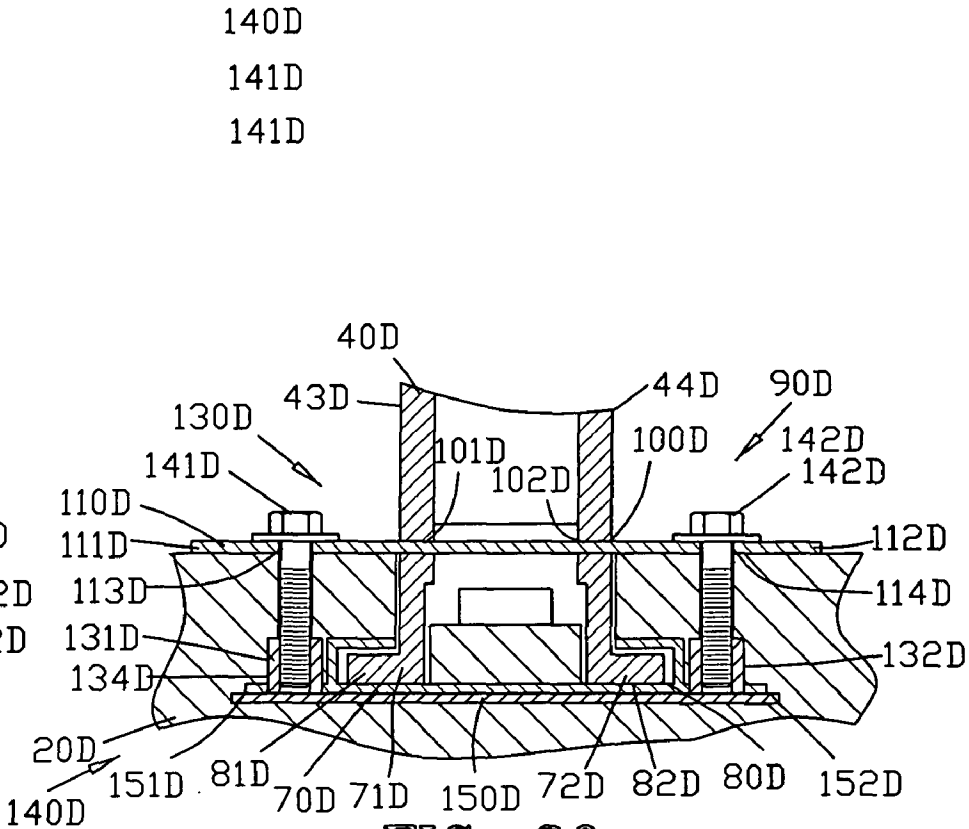
FIG. 30 is a magnified view of a portion of FIG. 29.
Figure 29:
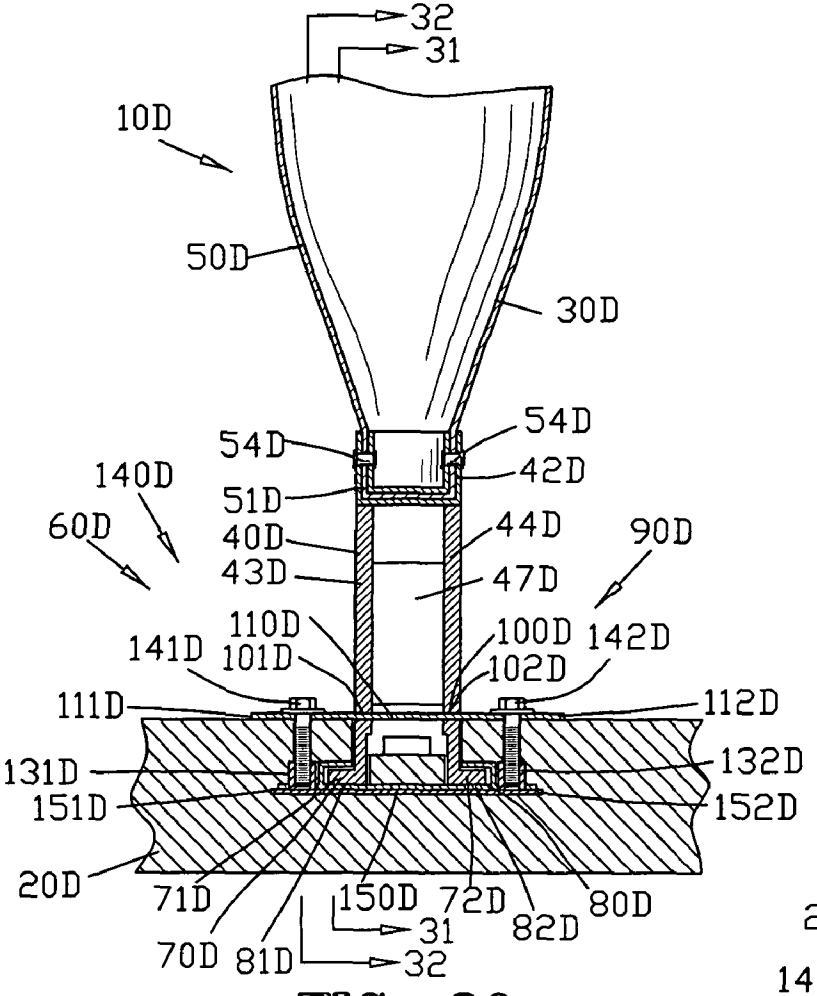
FIG. 29 is an enlarged sectional view along line 29-29 in FIG. 28.
Figure 32:
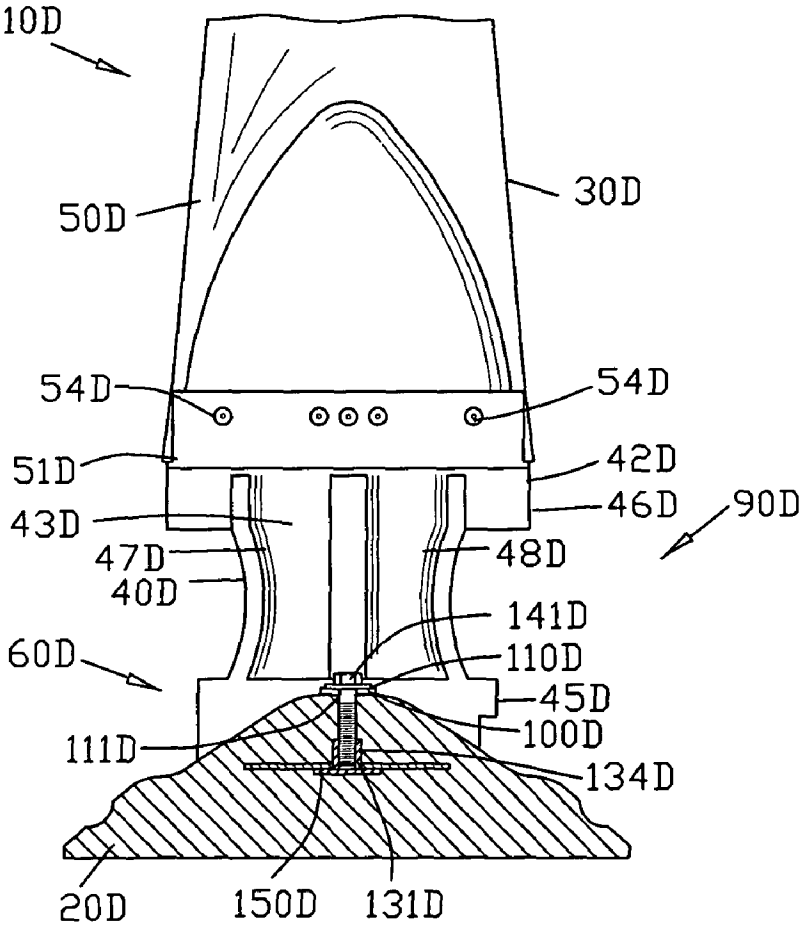
FIG. 32 is a sectional view along line 32-32 in FIG. 30.
Figure 31:
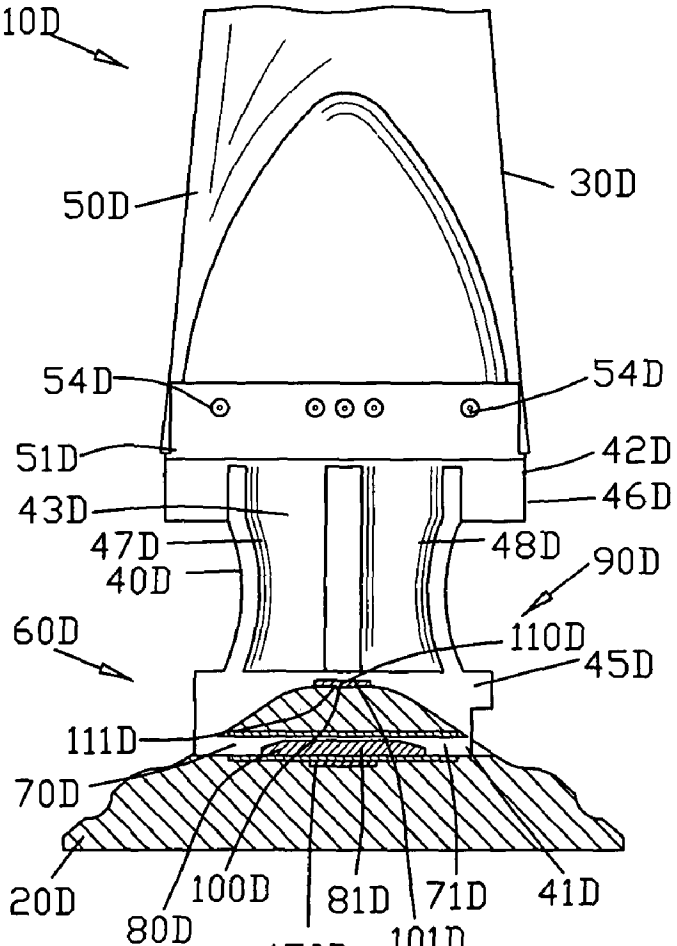
FIG. 31 is a sectional view along line 31-31 in FIG. 30.
Figure 33:
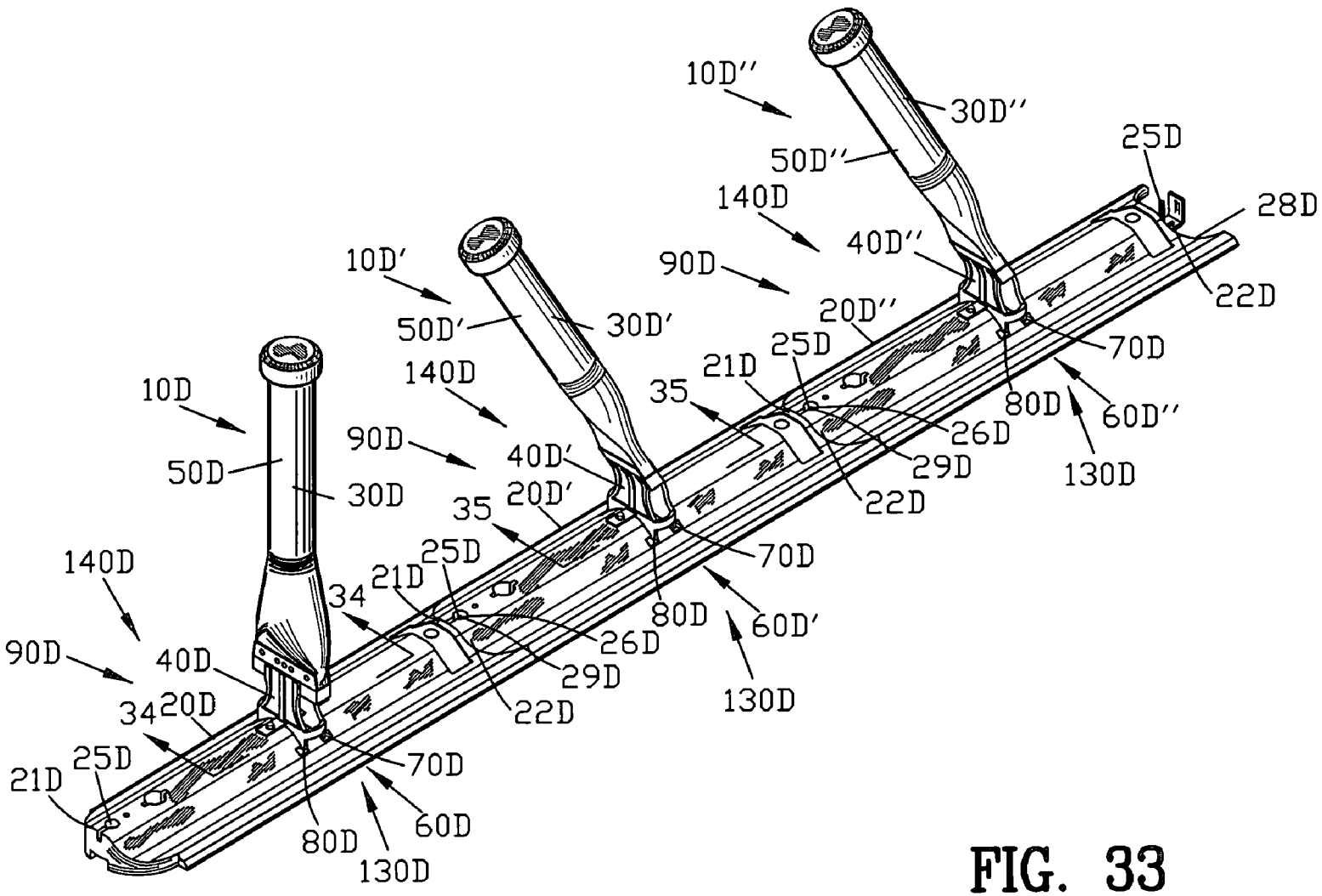
FIG. 33 is an isometric view illustrating a series of signaling bodies of FIG. 29 locked to a series of holding devices with the signaling bodies being deflected relative to the holding devices.
Figure 35:
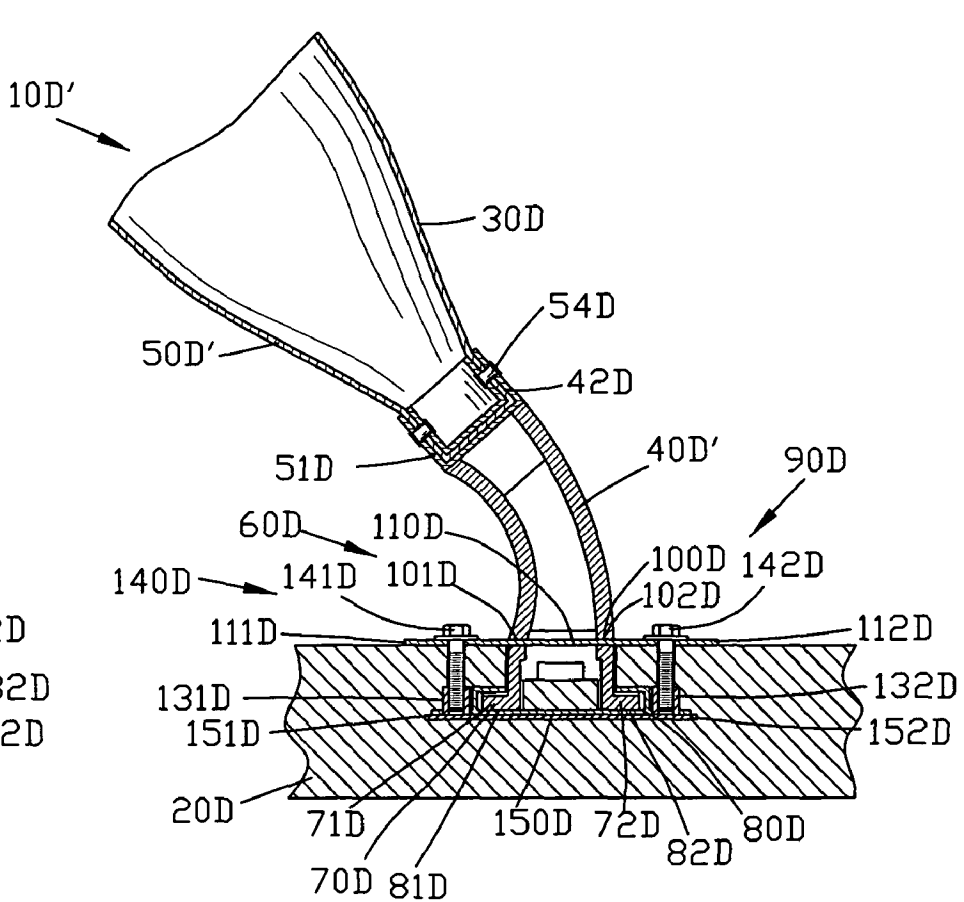
FIG. 35 is an enlarged sectional view along line 35-35 in FIG. 33.
Figure 34:
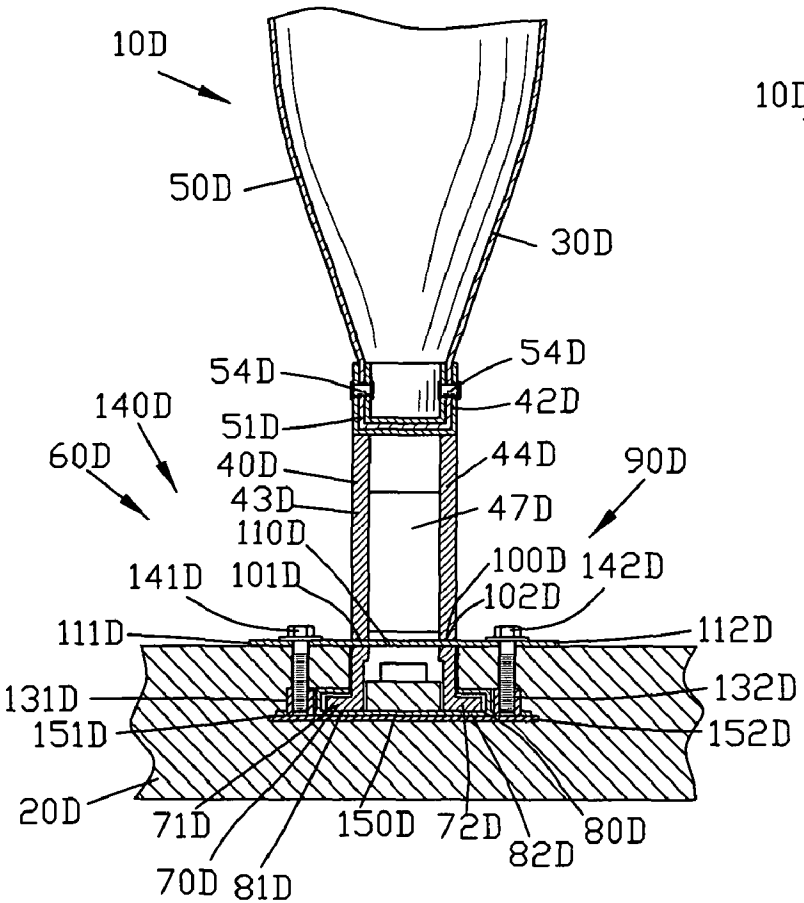
FIG. 34 is an enlarged sectional view along line 34-34 in FIG. 33.

As best shown in FIG. 30, the locking device 90D comprises plural threaded female fasteners 130D located within the holding device 20D. The plural threaded female fasteners 30D are adapted to receive plural threaded male fasteners 140D for securing the locking bar 110D to the holding device 20D.

The threaded female fasteners 130D are shown as a first and a second threaded female fasteners 131D and 132D. Each of the first and second threaded female fasteners 131D and 132D is shown as a generally cylindrical shaped boss 134D. The first and second threaded female fasteners 131D and 132D are secured to a first and a second end 151D and 152D of a longitudinally extending anchor plate 150D. The first and second threaded female fasteners 131D and 132D may be secured to the longitudinally extending anchor plate 150D by weld, braising or other suitable and appropriate fasteners.

The longitudinally extending anchor plate 150D provides a large surface area for anchoring the first and second threaded female fasteners 131D and 132D within the holding device 120D. The large surface area of the longitudinally extending anchor plate 150D provides a secure anchor for the first and second threaded female fasteners 131D and 132D.

In this embodiment of the invention, the first and second threaded female fasteners 131D and 132D and the longitudinally extending anchor plate 150D are molded into the holding device 20D. The plural threaded male fastener 140D are shown as a first and a second threaded male fasteners 141D and 142D. The first and second threaded male fasteners 141D and 142D are shown as bolts for engaging with the threaded female fasteners 131D and 132D.

The use of the first and second threaded female fasteners 131D and 132D cooperating with first and second threaded male fasteners 141D and 142D has several advantages over the prior embodiments. Firstly, the first and second threaded female fasteners 131D and 132D and the first and second threaded male fasteners 141D and 142D are formed from metallic materials. The metallic interconnection between the first and second threaded female fasteners 131D and 132D and the first and second threaded male fasteners 141D and 142D provide enhanced mechanical strength for securing the locking bar 110D. Secondly, the first and second threaded female fasteners 131D and 132D and the first and second threaded male fasteners 141D and 142D have a substantially increased cross-sectional dimension relative to the prior embodiments to further provide enhanced mechanical strength for securing the locking bar 110D.

For example, the first and second threaded male fasteners 141D and 142D shown in FIGS. 27-35 typically use a one-half inch diameter threaded bolts threadably engaging with one-half inch diameter first and second threaded female fasteners 131D and 132D. The one-half inch diameter threaded bolts 140D and the one-half inch diameter threaded female fastener 130D provide more significant fastening relative to the plurality of threaded fasteners shown in the prior embodiment.

In the prior embodiments, self-tapping screws were to be used to secure the locking bar 110D to the holding device 20D. Typically, only self tapping screws having a diameter of ⅜ of an inch or less could be inserted into the holding device 20D without drilling a pilot hole within the holding device 20D. If a half inch threaded screw is inserted into the holding device 20D, a pilot hole would have to be predrilled into the holding device 20D. The necessity for drilling a pilot hole into the holding device 20D required the use of an electric or a pneumatic drill thus adding to the complexity of the installation. Furthermore, the self-tapping screws of the prior embodiments created permanent screw holes with the holding device 20D. The permanent screw holes created within the holding device 20D impaired the ability to disassemble and reassemble the holding device 20D of the prior embodiments.

Figure 37:
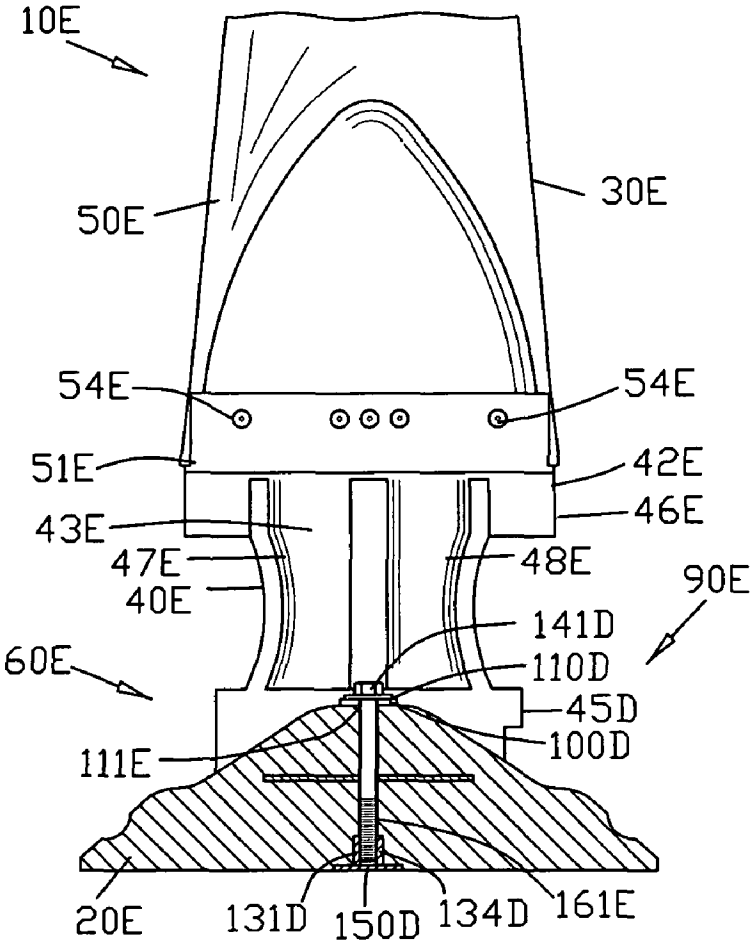
FIG. 37 is view similar to FIG. 32 illustrating the fifth embodiment of the traffic beacon of FIG. 30.
Figure 36:
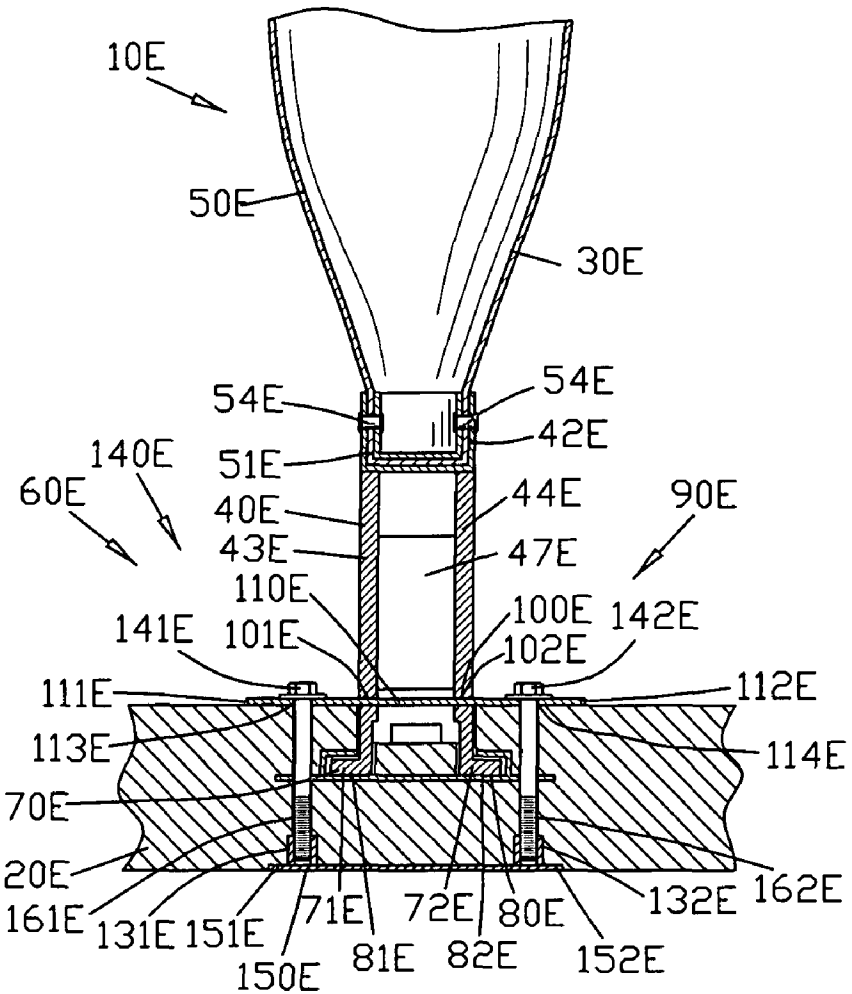
FIG. 36 is a view similar to FIG. 30 illustrating a fifth embodiment of the traffic beacon.
Figure 38:
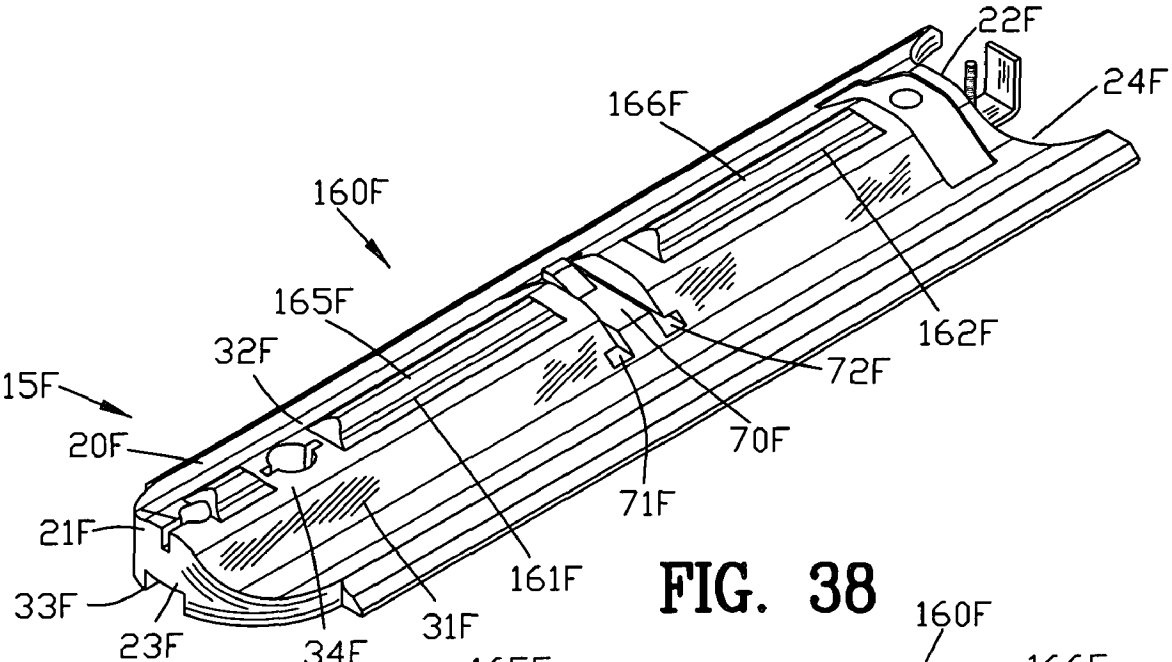
FIG. 38 is a sixth embodiment of the invention illustrating an isometric view of an improved holding device for supporting a traffic beacon.
Figure 39:
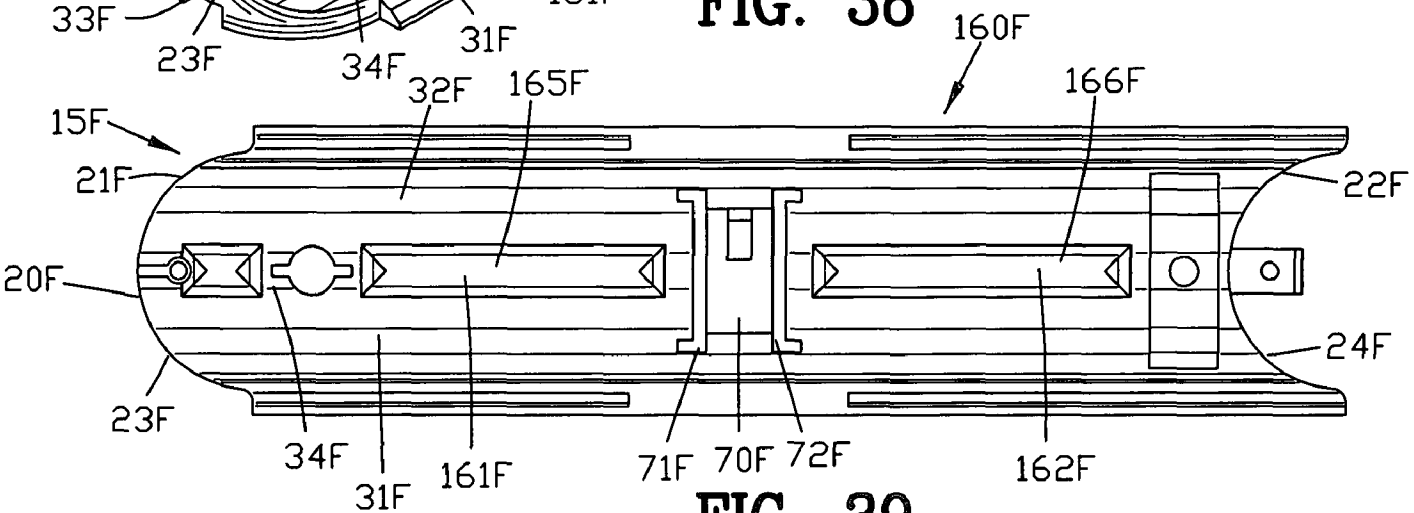
FIG. 39 is a top view of an improved holding device of FIG. 38.
Figure 40:
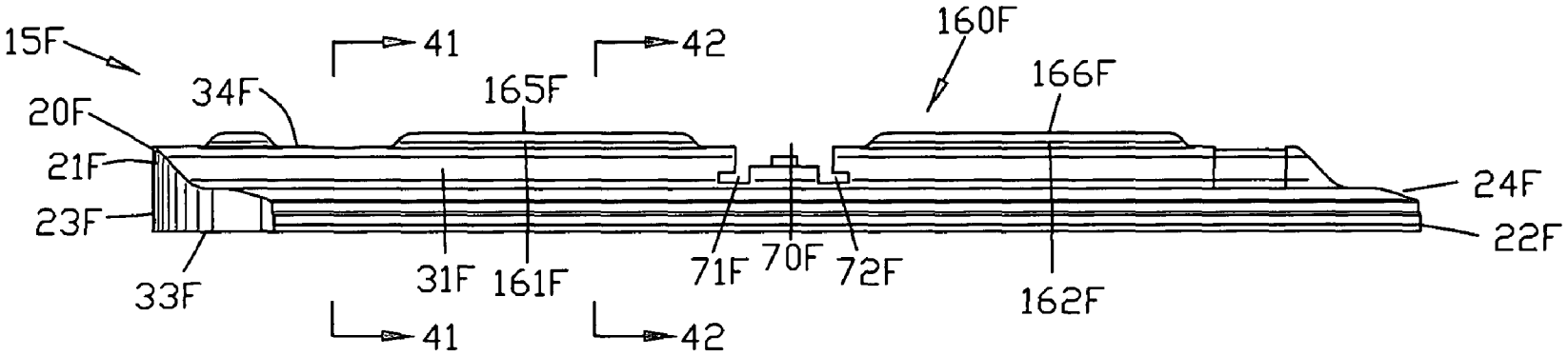
FIG. 40 is a side view of FIG. 39.
Figure 42:
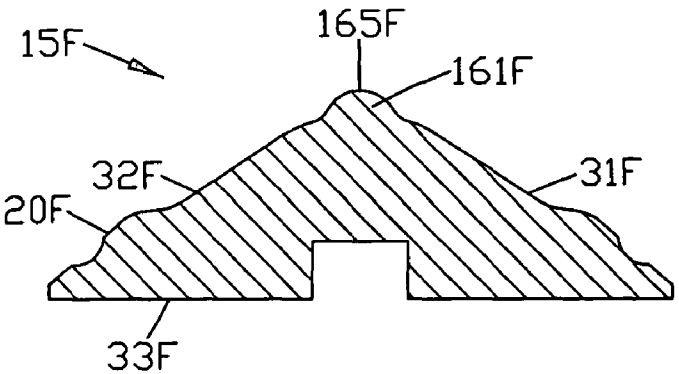
FIG. 42 is a sectional view along line 42-42 in FIG. 40.
Figure 41:
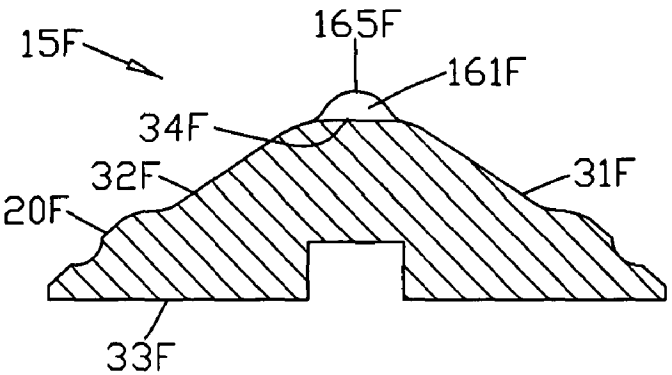
FIG. 41 is a sectional view along line 41-41 in FIG. 40.

FIGS. 36 and 37 show a fifth embodiment of the improved traffic beacon 10E illustrating the signaling body 30E locked to the holding device 20E. In this embodiment of the invention, the threaded female fasteners 30E may be retrofitted into a conventional holding device 20E. The first and second threaded female fasteners 131E and 132E are secured to a first and a second end 151E and 152E of a longitudinally extending anchor plate 150E by weld, braising or other suitable and appropriate fasteners. The first and second threaded female fasteners 131E and 132E are secured to the longitudinally extending anchor plate 150E to be in alignment with a first and a second hole 161E and 162E drilled into the holding device 20E. Preferably, the generally cylindrical shaped boss 134E of the first and second threaded female fasteners 131E and 132E are slightly larger than the first and second holes 161E and 162E drilled into the holding device 20E for allowing the first and second threaded female fasteners 131E and 132E to be press fitted and to be retained by the first and second holes 161E and 162E drilled into the holding device 20E.

It should be appreciated by those skilled in the art that the longitudinally extending anchor plate 150E may be formed as plural separate anchor plates (not shown). In the alternative, the longitudinally extending anchor plate 150E may be formed as plural separate anchor plates such as enlarged washers or the like.

The improved locking device may be adapted to existing traffic beacons of the prior art. Although the preferred embodiment of the invention illustrates the locking device that may be incorporated into existing traffic beacons of the prior art.

Although the locking device has been shown as a generally flat bar, it should be understood that the locking device may take various shapes and forms to accommodate the traffic beacons of the prior art. The locking device of the invention may take various shapes and forms to extend over the prior art coupling securing the signaling body to the holding device.

The invention shown in FIGS. 1-37 provides a locking device for a traffic beacon that interlocks a signaling body coupled to a base holding device of the traffic beacon. Although the invention shown in FIGS. 1-37 is described with reference to a signaling body 30 having a lower portion 40 and an upper portion 50, it should be understood that the invention shown in FIGS. 1-37 is suitable for use with a signaling body 30 formed from a unitary, single piece construction.

The invention shown in FIGS. 1-37 prevents the decoupling of the signaling body from the base holding device upon severe deflection of the signaling body relative to the base holding device. The improved locking device may be readily unlocked to enable the signaling body to be removed from the base holding device of the traffic beacon.

The invention shown in FIGS. 1-37 provides a locking device for a traffic beacon that interlocks a signaling body coupled to a base holding device of the traffic beacon. Although the invention shown in FIGS. 1-37 is described with reference to a signaling body having a lower portion and an upper portion, it should be understood that the present invention is suitable for use with a signaling body formed from a unitary, single piece construction.

The invention shown in FIGS. 1-37 prevents the decoupling of the signaling body from the base holding device upon severe deflection of the signaling body relative to the base holding device. The improved locking device may be readily unlocked to enable the signaling body to be removed from the base holding device of the traffic beacon.

FIGS. 38-42 illustrate a sixth embodiment of the invention of an improved holding device 15F for supporting the traffic beacons 10 shown in FIGS. 11-16. The holding device 15F comprises a longitudinal extending holding member 20F having a first end 21F and a second end 22F. The longitudinal extending holding member 20F defines a longitudinal extending holding member axis 20X therebetween.

In a manner similar to the embodiments shown heretofore, the first end 21F of the holding device 20F has a generally convex shape 23F whereas the second end 22F of the holding device 20F has a generally concave shape 24F. The generally convex shape 23F of the first end 21F and the generally concave shape 24F of the second end 22F enables a multiplicity of holding devices 20F to be connected in series to form a continuous holding device unit as shown in FIGS. 5 and 6.

The longitudinal extending holding member 20F has a first and a second inclined opposed sidewalls 31F and 32F emanating from generally flat bottom surface 33F. The first and a second inclined opposed sidewalls 31F and 32F meet in a generally planar top surface 34F. The first and second opposed inclined sidewalls 31F and 32F are angled upwardly and inwardly from the bottom surface 33F. The generally planar top surface 34F is disposed parallel to the generally flat bottom surface 33F.

The improved holding device 15F includes a coupling device defined within the longitudinal extending holding member 20F for securing a traffic beacon 10 to the holding member 15F. In a manner similar to the embodiments shown heretofore, the coupling member 70F defined by the holding device 20F is shown as transverse slots 71F and 72F. The transverse slots 71F and 72F cooperate with the opposed flanges 81 and 82 as shown in FIGS. 14-15 and 17-18. The opposed flanges 81 and 82 are inserted into the transverse slots 71F and 72F for coupling the signaling body 30 to the holding device 20F.

The improved holding device 15F includes a riser 160F located on the generally planar top surface of the longitudinal extending holding member 20F. In this example, the riser 160F includes identical first and second risers 161F and 162F located on opposite sides of the coupling device 70F. The first and second risers 161F and 162F are integrally formed with the longitudinal extending holding member 20F. Preferably, the holding device 20F including the longitudinal extending holding member 20F and the risers 160F are formed from a polymeric material as a one-piece unit.

Each of the risers 161F and 162F has a riser lower region 163F and 164F integrally formed upon the generally planar top surface 34F of the longitudinal extending holding member 20F. Each of the risers 161F and 162F has a generally partially cylindrical riser region 165F and 166F for raising the height of the improved holding device 15F.

In this example, height of the longitudinal extending holding member 20F has a height of 3.5 inches and a width of 12 inches. The longitudinal extending holding member 20F has an approximate cross-sectional area of 22 square inches. The risers 161F and 162F have a height of 0.5 inches and a width of 2.0 inches. The risers 161F and 162F define riser radii of curvature of 0.75 inches and have approximate cross-sectional areas of 0.5 square inches. The risers 161F and 162F raise the height of the improved holding device 15F by approximately 15 percent (15%) with an increase of weight of only two percent (2%).

The present invention provides a holding device for supporting a traffic beacon that having an improved holding device with an increased height without substantially increasing the weight of the holding device. The riser may be integrally formed with the holding device in a single molding operation. The improved holding device does not appreciably increase the cost of manufacture of the holding device.

Although the invention has been described in its preferred form with a certain degree of particularity, it is understood that the present disclosure of the preferred form has been made only by way of example and that numerous changes in the details of construction and the combination and arrangement of parts may be resorted to without departing from the spirit and scope of the invention.

What is claimed is:

1. A holding device for supporting a traffic beacon, comprising:

a longitudinal extending holding member having a first end and a second end defining a holding member length;

a longitudinal extending holding member axis extending between said first and second ends of said longitudinal extending holding member;

said longitudinal extending holding member having a bottom surface for resting on a generally flat surface;

said longitudinal extending holding member having inclined opposed sidewalls extending transverse to said holding member axis;

said opposed inclined sidewalls being angled upwardly from said bottom surface to meet in a generally planar top surface;

said generally planar top surface being disposed parallel to said longitudinal extending axis;

a coupling device defined within said longitudinal extending holding member disposed transverse to said longitudinal extending axis for securing a traffic beacon to said holding member;

a riser having a riser lower region integrally formed upon said generally planar top surface and top upper region of said longitudinal extending holding member;

said riser having a generally partially cylindrical riser region for raising the height of the improved holding device;

said riser extending between a first riser end and a second riser end defining a longitudinal riser length; and said riser length being shorter than said holding member length.

2. A holding device for supporting a traffic beacon as set forth in claim 1, wherein said holding member is formed from a polymeric material.

3. A holding device for supporting a traffic beacon as set forth in claim 1, wherein said first end of a first longitudinal extending holding member is adapted to engage with a second end of a second longitudinal extending holding member for forming a continuous holding device unit.

4. A holding device for supporting a traffic beacon as set forth in claim 1, wherein said coupling including a transverse slot defined within said longitudinal extending holding member for supporting a vertically extending traffic beacon.

5. A holding device for supporting a traffic beacon as set forth in claim 1, wherein said coupling includes a transverse slot defined within said longitudinal extending holding member for supporting a vertically extending traffic beacon; and said riser being located on one side of said transverse slot.

6. A holding device for supporting a traffic beacon as set forth in claim 1, wherein said raiser comprises a first and a second riser located on opposed sides of said coupling device.

7. A holding device for supporting a traffic beacon as set forth in claim 1, wherein said riser has a width substantially less than said bottom surface of said longitudinal extending holding member.

8. A holding device for supporting a traffic beacon, comprising:

a longitudinal extending holding member having a first end and a second end defining a longitudinal extending axis extending between said first and second ends of said longitudinal extending holding member;

said longitudinal extending holding member having a bottom surface for resting on a generally flat surface;

said longitudinal extending holding member having inclined opposed sidewalls extending transverse to said holding member axis;

said opposed inclined sidewalls being angled upwardly from said bottom surface to meet in a generally planar top surface;

said generally planar top surface being disposed parallel to said longitudinal extending axis;

a coupling device comprising a slot defined within said longitudinal extending holding member disposed transverse to said longitudinal extending axis for securing a traffic beacon to said holding member;

a first and a second riser located on opposed sides of said coupling device;

each of said first and second risers having a riser lower region coincident with said generally planar top surface and a riser upper region defining a generally partially cylindrical riser surface for raising the height of the improved holding device;

said first and second risers being integrally formed with said longitudinal extending holding member as a one piece unit; and said riser having a width substantially less than said bottom surface of said longitudinal extending holding member for increasing the total height of the holding device by approximately fifteen percent (15%) while increasing the weight of the holding device by approximately two percent (2%).

9. A holding device for supporting a traffic beacon as set forth in claim 8, wherein said holding member is formed from a polymeric material.

10. A holding device for supporting a traffic beacon as set forth in claim 8, wherein said first end of a first longitudinal extending holding member is adapted to engage with a second end of a second longitudinal extending holding member for forming a continuous holding device unit.

11. A holding device for supporting a traffic beacon as set forth in claim 8, wherein said longitudinal extending holding member defines a holding member length between said first and second ends of said longitudinal extending holding member;

said riser defining a longitudinal riser length extending between a first riser end and a second riser end; and said riser length being shorter than said holding member length.

* * * * *